US008152415B2

(12) United States Patent
Fox et al.

(10) Patent No.: US 8,152,415 B2
(45) **Date of Patent: *Apr. 10, 2012**

(54) METHOD AND APPARATUS FOR BUILDING SUPPORT PIERS FROM ONE OR MORE SUCCESSIVE LIFTS FORMED IN A SOIL MATRIX

(75) Inventors: Nathaniel S. Fox, Las Vegas, NV (US); Lorenz Weppler, Abu Dhabi (AE)

(73) Assignee: Geopier Foundation Company, Inc., Mooresville, NC (US)

( * ) Notice: Subject to any disclaimer, the term of this patent is extended or adjusted under 35 U.S.C. 154(b) by 266 days.

This patent is subject to a terminal disclaimer.

(21) Appl. No.: 11/876,556

(22) Filed: Oct. 22, 2007

(65) Prior Publication Data

US 2008/0101873 A1 May 1, 2008
US 2011/0243667 A9 Oct. 6, 2011

Related U.S. Application Data

(63) Continuation-in-part of application No. 11/747,271, filed on May 11, 2007, now Pat. No. 7,901,159, which is a continuation of application No. 10/728,405, filed on Feb. 12, 2004, now Pat. No. 7,226,246, and a continuation-in-part of application No. 10/178,676, filed on Jun. 24, 2002, now Pat. No. 6,688,815, which is a continuation of application No. 09/882,151, filed on Jun. 15, 2001, now Pat. No. 6,425,713.

(60) Provisional application No. 60/513,755, filed on Oct. 23, 2003, provisional application No. 60/211,773, filed on Jun. 15, 2000.

(51) Int. Cl.
*E02D 3/02* (2006.01)
*E02D 3/12* (2006.01)

(52) U.S. Cl. ..... 405/240; 405/255; 405/271; 175/424

(58) Field of Classification Search ..... 405/231, 405/232, 240, 243, 248, 249, 255, 271; 175/424
See application file for complete search history.

(56) References Cited

U.S. PATENT DOCUMENTS 822,588 A 6/1906 Cummings
(Continued)

FOREIGN PATENT DOCUMENTS

JP 59055913 A 3/1984
(Continued)

OTHER PUBLICATIONS

Translation of Russian Office Action dated Jun. 19, 2008 pertaining to Russian Patent Application No. 2006117533, including translation of applicable sections of Russian patent document SU1362784.

*Primary Examiner* — Tara Mayo-Pinnock
(74) *Attorney, Agent, or Firm* — Ward and Smith, P.A.

(57) ABSTRACT

A method and apparatus for forming a support aggregate pier having compacted aggregate lifts in a soil matrix, includes an elongate, hollow tube with a bulbous leading end bottom head element that is forced or lowered into the soil matrix. The hollow tube includes a mechanism for releasing aggregate from the lower head element of the tube as the tube is lifted in predetermined increments. The same hollow tube is then lowered or pushed in predetermined increments to vertically compact the released aggregate in thin aggregate lifts, while forcing a portion of the compacted aggregate transaxially into the soil matrix at the sidewalls of the cavity. The process may be repeated to form a series of compacted aggregate lifts comprising an aggregate pier or the process may include forming only a single lift for the aggregate pier while densifying adjacent matrix soils and imparting lateral stress in these soils.

29 Claims, 13 Drawing Sheets

U.S. PATENT DOCUMENTS

| | | | |
|---|---|---|---|
| 822,589 | A | 6/1906 | Cummings |
| 850,389 | A | 4/1907 | McClintock |
| 872,093 | A | 11/1907 | Stewart |
| 977,356 | A | 11/1910 | Withrow |
| 1,249,850 | A | 12/1917 | Stewart |
| 1,477,567 | A | 12/1923 | Lancaster |
| 2,729,067 | A | 1/1956 | Patterson |
| 3,137,483 | A | 6/1964 | Zinkiewicz |
| 3,151,687 | A | 10/1964 | Sato et al. |
| 3,270,511 | A | 9/1966 | Colle |
| 3,344,611 | A | 10/1967 | Philo |
| 3,420,067 | A | 1/1969 | Bjerking |
| 3,465,834 | A | 9/1969 | Southworth, Jr. |
| 3,485,834 | A | 12/1969 | Suter et al. |
| 3,512,366 | A | 5/1970 | Turzillo |
| 3,568,452 | A | 3/1971 | Stifler, Jr. |
| 3,772,892 | A | 11/1973 | Ogawa |
| 3,831,386 | A | 8/1974 | Phares et al. |
| 3,865,200 | A | 2/1975 | Schmidt |
| 3,869,869 | A | 3/1975 | Pao Chen |
| 4,026,370 | A | 5/1977 | Foster et al. |
| 4,078,619 | A | 3/1978 | Sudnishnikov et al. |
| 4,091,661 | A | 5/1978 | Handy et al. |
| 4,230,425 | A | 10/1980 | Gusev et al. |
| 4,487,524 | A | 12/1984 | Shono et al. |
| 4,648,746 | A | 3/1987 | Abinett |
| 5,145,285 | A | 9/1992 | Fox et al. |
| 5,152,639 | A | 10/1992 | Visconti |
| 5,249,892 | A | 10/1993 | Fox et al. |
| 5,540,443 | A | 7/1996 | Ballan et al. |
| 6,354,766 | B1 | 3/2002 | Fox |
| 6,354,768 | B1 | 3/2002 | Fox |
| 6,425,713 | B2 | 7/2002 | Fox et al. |
| 6,540,443 | B2 | 4/2003 | Kato et al. |
| 6,688,815 | B2 | 2/2004 | Fox et al. |
| 6,881,013 | B2 | 4/2005 | Otsuka et al. |
| 7,226,246 | B2 | 6/2007 | Fox |

FOREIGN PATENT DOCUMENTS

| | | | |
|---|---|---|---|
| JP | 62242011 | A | 10/1987 |
| JP | 02132217 | A | 5/1990 |
| RU | 2001124823 | A | 7/2003 |
| SU | 1362784 | A1 | 12/1987 |

FIG.1
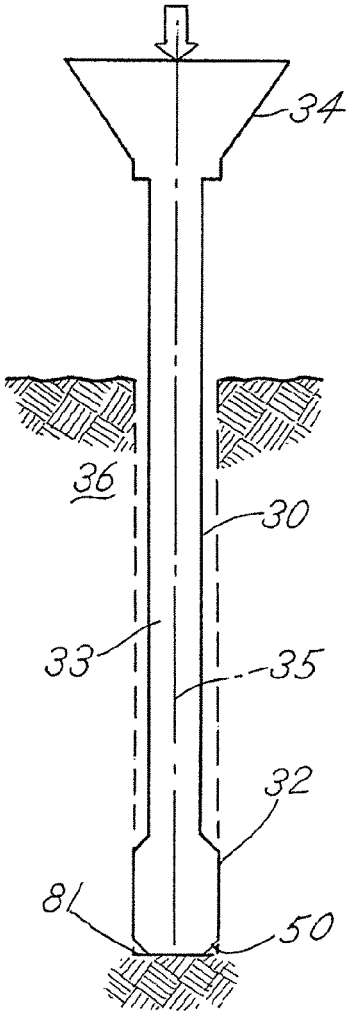
FIG.2
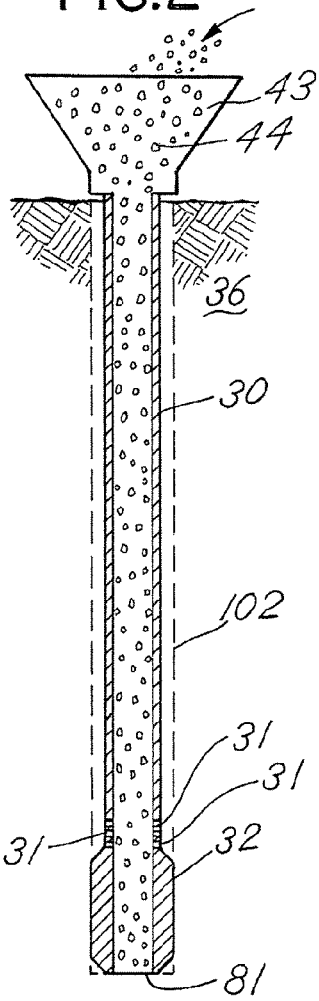
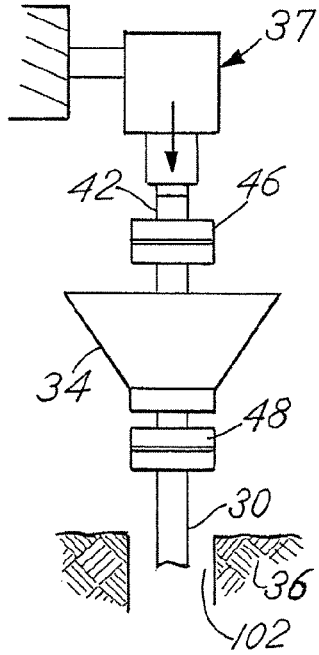
FIG.3
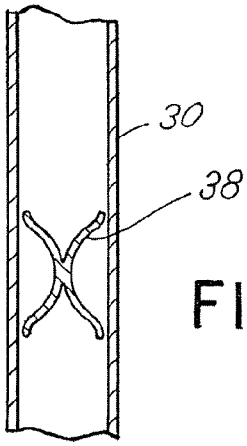
FIG.4

FIG.3A
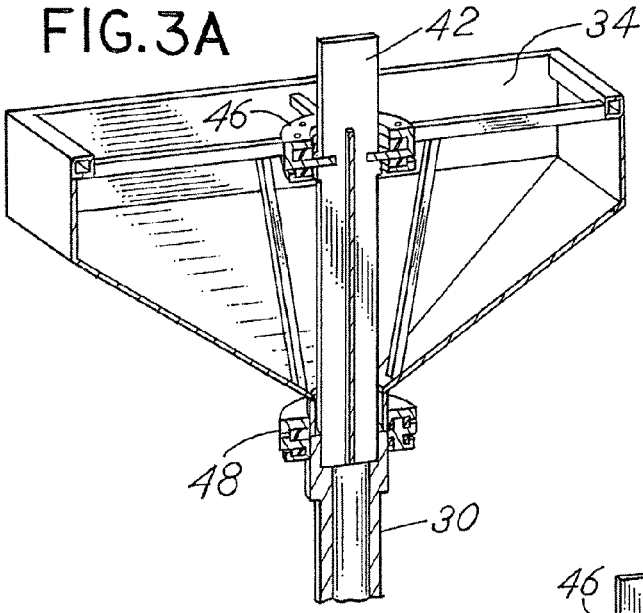
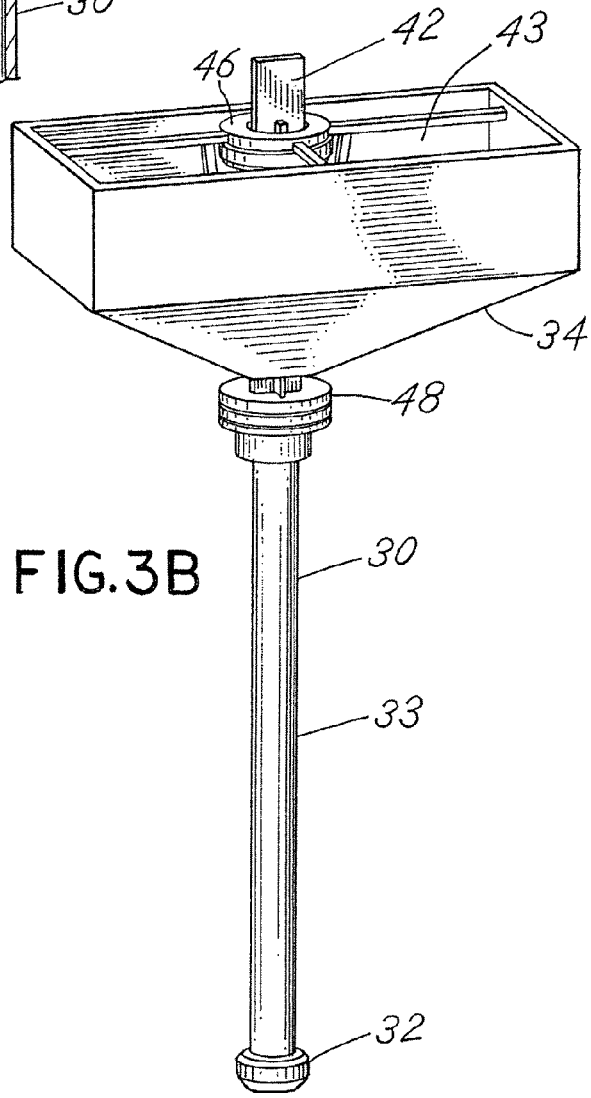
FIG.3B

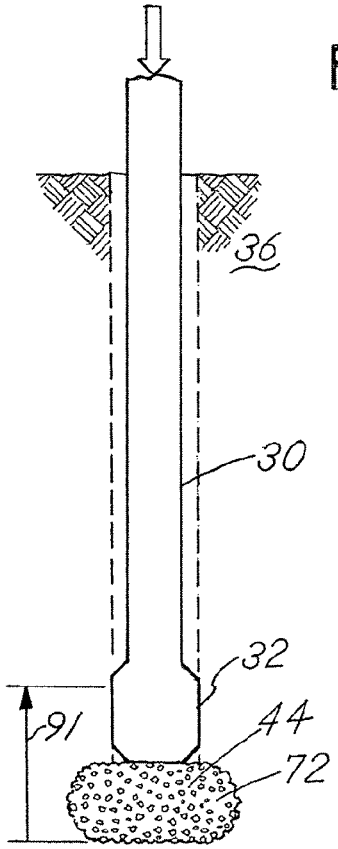
FIG.9
FIG.12
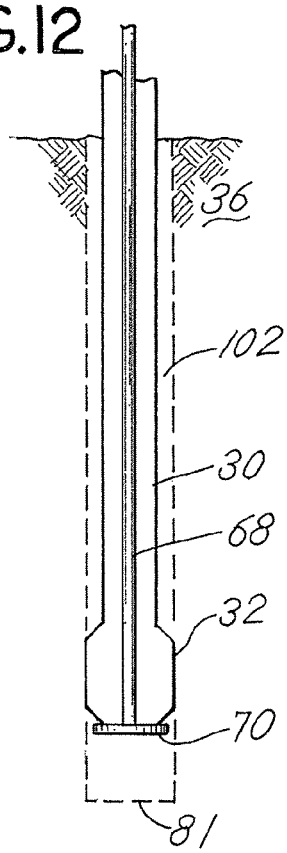
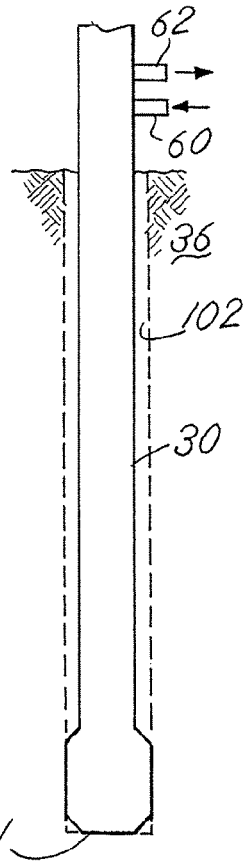
FIG.13
FIG.10
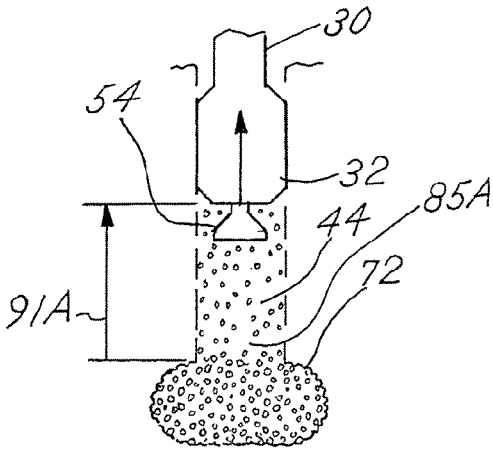
FIG. 11
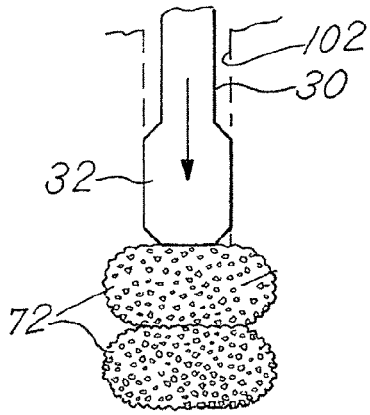

FIG.14
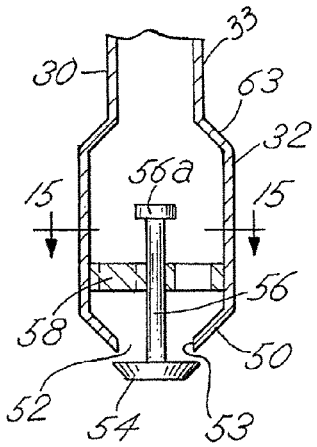
FIG.16
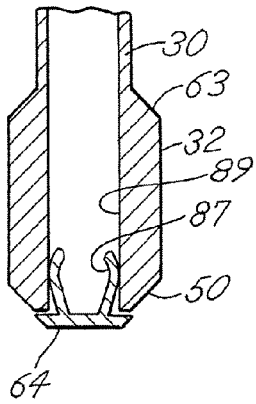
FIG.17
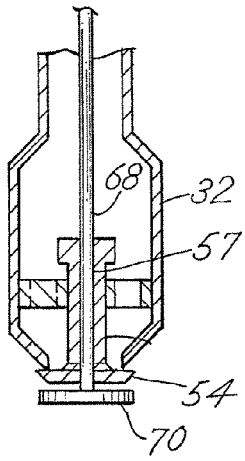
FIG.18
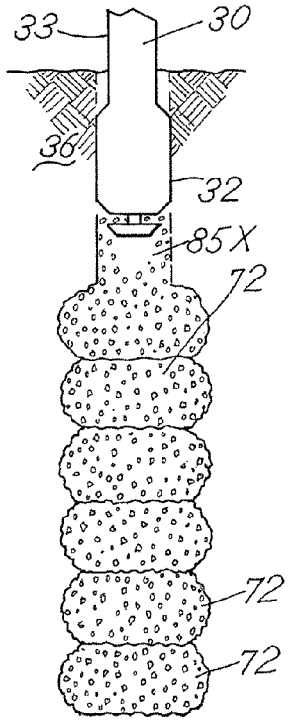
FIG. 19
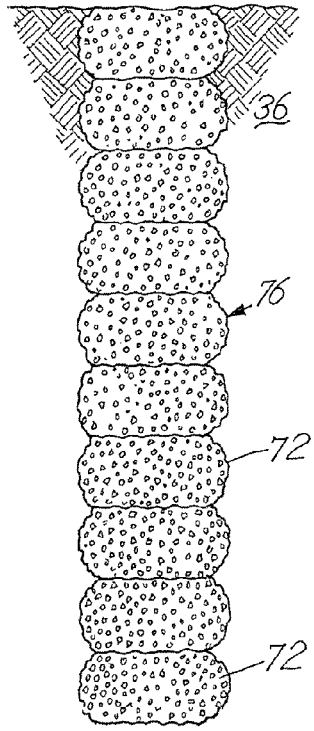
FIG.15
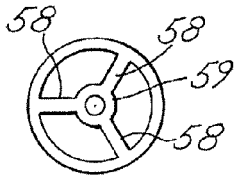
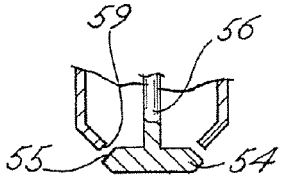
FIG.15A FIG.27
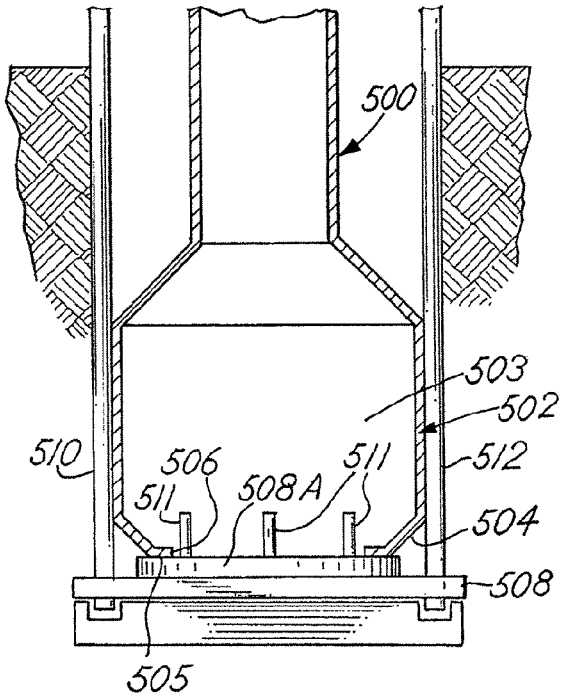
FIG.27A
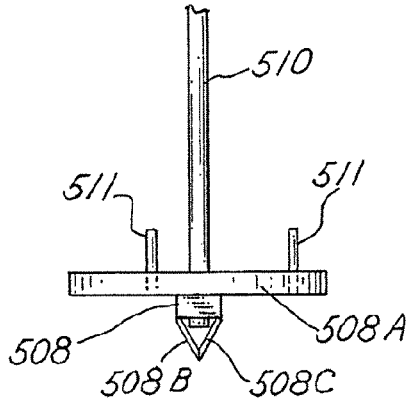
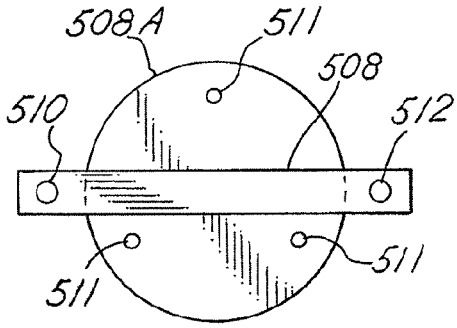
FIG.27B
FIG.28
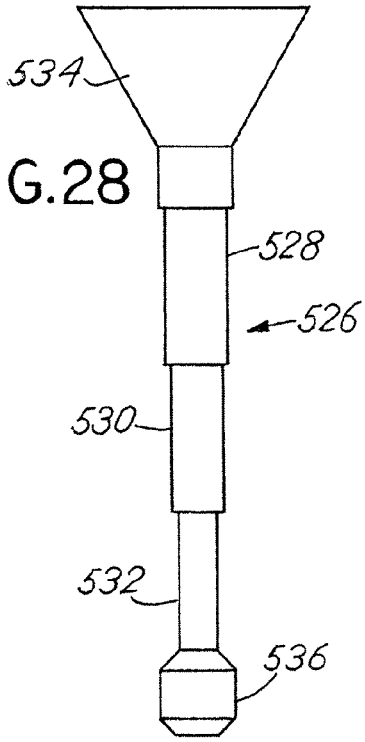

FIG.29
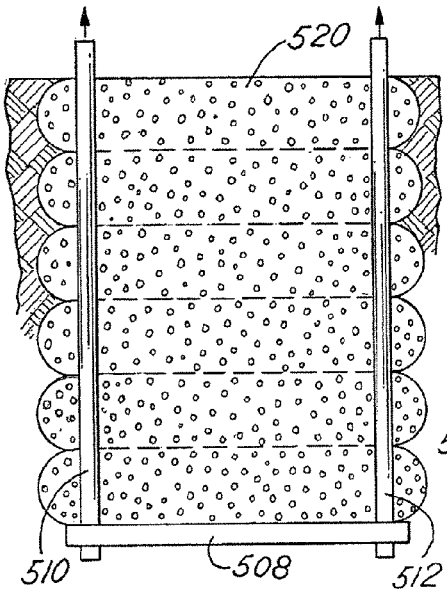
FIG.30
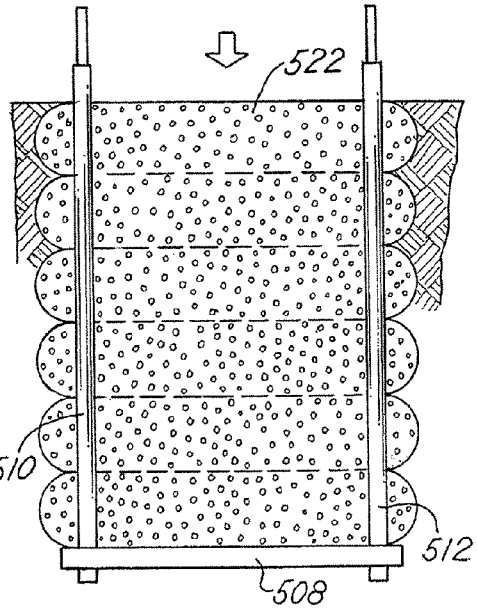
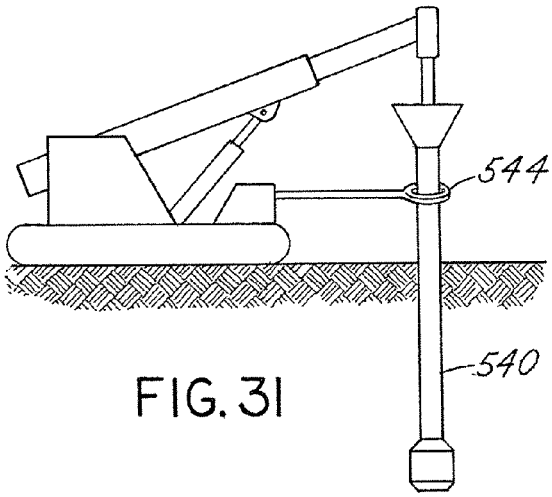
FIG.31
FIG.32
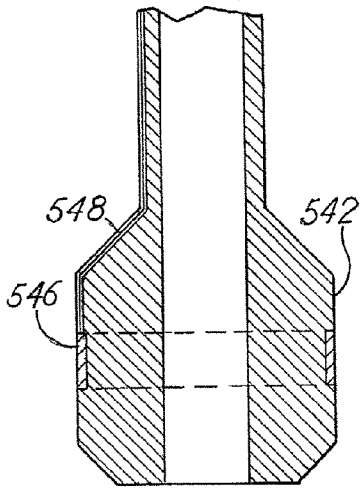

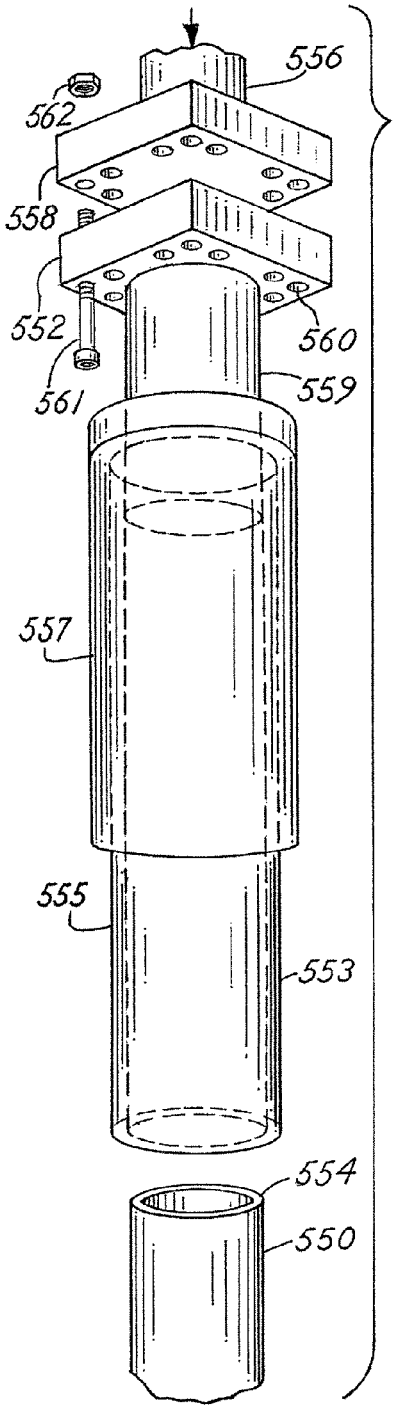
FIG.33
FIG.34
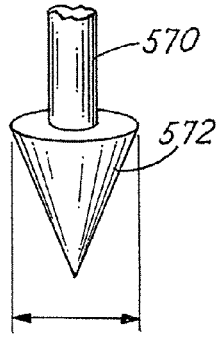
FIG.35
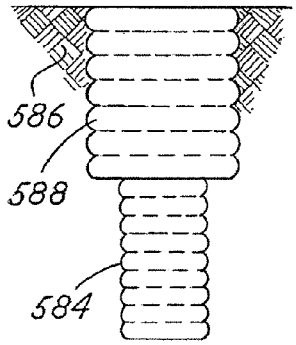
FIG.36
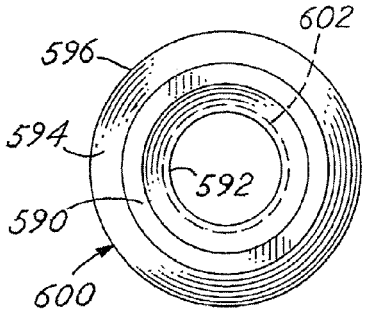

METHOD AND APPARATUS FOR BUILDING SUPPORT PIERS FROM ONE OR MORE SUCCESSIVE LIFTS FORMED IN A SOIL MATRIX

CROSS REFERENCE TO RELATED APPLICATION

This application is a continuation in part application of Ser. No. 11/747,271 filed May 11, 2007 which is a continuation of Ser. No. 10/728,405 filed Feb. 12, 2004 which is a utility application based upon provisional application Ser. No. 60/513,755 filed Oct. 23, 2003, all of which are incorporated herein by reference and for which priority is claimed.

BACKGROUND OF THE INVENTION

In a principal aspect, the present invention relates to a method and apparatus for constructing a support pier comprised of one or more compacted lifts of aggregate material. The apparatus enables formation or construction of a single or multi-lift pier within a soil matrix while simultaneously reinforcing the soil adjacent the pier. The apparatus thus forms a cavity in the soil matrix by forcing a hollow tube device into the soil matrix followed by raising the tube device, releasing or injecting aggregate through the tube device into the cavity section beneath the raised tube device and then for multi-lift piers driving, pushing, lowering, and/or forcing, the tube device downward to compact the released aggregate material while simultaneously forcing the aggregate material vertically downward and laterally outward into the surrounding soil matrix.

In U.S. Pat. No. 5,249,892, incorporated herewith by reference, a method and apparatus are disclosed for constructing short aggregate piers in situ. The process includes drilling a cavity in a soil matrix and then introducing and compacting successive layers or lifts of aggregate material in the cavity to form a pier that can provide support for a structure. Such piers are made by first drilling a hole or cavity in a soil matrix, then removing the drill, then placing a relatively small, discrete layer of aggregate in the cavity, and then ramming or tamping the layer of aggregate in the cavity with a mechanical tamper. The mechanical tamper is typically removed after each layer is compacted, and additional aggregate is then placed in the cavity for forming the next compacted layer or lift. The lifts or layers of aggregate, which are compacted during the pier forming process, typically have a diameter of 2 to 3 feet and a vertical rise of about 12 inches.

This apparatus and process produce a stiff and effective stabilizing column or pier useful for the support of a structure. However this method of pier construction has a limitation in terms of the depth at which the pier forming process can be accomplished economically, and the speed with which the process can be conducted. Another limitation is that in certain types of soils, especially sand soils, cave-ins occur during the cavity drilling or forming process and may require the use of a temporary casing such as a steel pipe casing. Use of a temporary steel casing significantly slows pier production and therefore increases the cost of producing piers. Thus, typically the process described in U.S. Pat. No. 5,249,892 is limited to forming piers in limited types of soil at depths generally no greater than approximately 25 feet.

As a result, there has developed a need for a unique pier construction process and associated special mechanical apparatus which can be successfully and economically utilized to form or construct aggregate piers at greater depths, at greater speeds of installation, and in sands or other soils that collapse and are unstable when drilled, without the need for a temporary casing, yet having the attributes and benefits associated with the short aggregate pier method, apparatus, and construction disclosed in U.S. Pat. No. 5,249,892, as well as additional benefits.

SUMMARY OF THE INVENTION

Briefly, the present invention comprises a method for installation of a pier formed from one or more layers or formed lifts of aggregate material, with or without additives, and includes the steps of positioning or pushing or forcing an elongate hollow tube having a special shaped bottom head element and unique tube configuration into a soil matrix, filling the hollow tube including the bottom head element with an aggregate material, releasing a predetermined volume of aggregate material from the bottom head element as the hollow tube is lifted a predetermined incremental distance in the cavity formed in the soil matrix, and then imparting an axial, static vector force and optional dynamic vector forces onto the hollow tube and its special bottom head element to transfer energy via the lower end of the shaped bottom head element of the hollow tube to the top of the lift of released aggregate material thereby vertically compacting the lift of aggregate material and also, simultaneously forcing a portion of the released aggregate material laterally or transaxially into the sidewalls of the cavity. Lifting of the hollow tube having the special bottom head element followed by pushing down with an applied axial or vertical static vector force and optional dynamic vector forces impacts the aggregate material which is not shielded by the hollow tube from the sidewalls of the cavity at the time of impaction, thereby densifying and vertically compacting the aggregate material as well as forcing a portion of the aggregate material laterally outward into the soil matrix due to the shaped bottom of the bulbous bottom head element facilitating lateral forces on and within the released aggregate material and therefore imparting lateral stress on the adjacent soil matrix. The released, compacted, and partially displaced aggregate material thus defines a "lift" which generally has a lateral dimension or diameter greater than that of the cavity formed by the hollow tube and bulbous bottom head element resulting in a pier construction formed of one or more compacted lifts of aggregate material.

The aggregate material is released from the special bottom head element of the hollow tube as the bulbous bottom head element is lifted, preferably in predetermined incremental steps, first above the bottom of the cavity and then above the top portion of each of the successive pier aggregate lifts that has been formed in the cavity and the adjacent soil matrix by the process. The aggregate material released from the hollow tube is compacted by the compacting forces delivered by the hollow tube and special bottom head element after the hollow tube has been lifted to expose a portion of the cavity while releasing aggregate material into that exposed portion. The hollow tube and bulbous bottom head element is next forced downward to vertically compact the aggregate and to push a portion of the aggregate laterally into the soil matrix. The aggregate material is thereby compacted and partially displaced in predetermined, sequential increments, or lifts. The process is continuously repeated along the length or depth of the cavity with the result that an aggregate pier or column of separately compacted lifts or layers is formed within the soil matrix. A vertically compacted aggregate pier having a length of fifty (50) feet or greater can be constructed in this manner in a relatively short period of time without removal of the hollow tube and special bottom head element from the soil.

The resulting vertically compacted aggregate pier also generally has a formed cross sectional dimension consistently greater than that of the hollow tube.

A number of types of aggregate material can be utilized in the practice of the process including crushed stone of many types from quarries, or re-cycled, crushed concrete. Additives may include water, dry cement, or grout such as water-cement sand-grout, fly-ash, hydrated lime or quicklime, or any other additive may be utilized which may improve the load capacity or engineering characteristics of the formed aggregate pier. Combinations of these materials may also be utilized in the process.

The hollow tube with the bulbous bottom head element may be positioned within the soil matrix by pushing and/or vertically vibrating or vertically ramming the hollow tube having the leading end, bulbous bottom head element into the soil with an applied axial or vertical vector static force and optionally, with accompanying dynamic vector forces. The soil matrix, which is displaced by initial forcing, pushing and/or vibrating the hollow tube with the special bottom head element, is generally displaced and compacted laterally and vertically downward into the preexisting soil matrix. If a hard or dense layer of soil is encountered, the hard or dense layer may be penetrated by pre-drilling or pre-penetrating that layer to form a cavity or passage into which the hollow tube and special bottom head element may be placed and driven.

The hollow tube is typically constructed from a uniform diameter tube with a bulbous bottom head element and may include an internal valve mechanism near or within the bottom head element or a valve mechanism at the lower end of the head element, or it may not include an internal valve closing and opening mechanism. The hollow tube is generally cylindrical with a constant, uniform, lesser diameter along an upper section of the tube. The bulbous or larger external diameter lower end of the hollow tube (i.e. bulbous bottom head element) is integral with the lesser diameter hollow tube or may be separately formed and attached to the lower end of the lesser diameter hollow tube. That is, the bulbous bottom head element is also typically cylindrical, and has a greater external diameter or external cross sectional profile than the remainder of the hollow tube and is concentric about the center line axis of the hollow tube. The lead end of the bulbous bottom head element is shaped to facilitate penetration into the soil matrix and to transmit desired vector forces to the surrounding soil during penetration as well as to the aggregate material subsequently released from the hollow tube. The transition from the lesser external diameter hollow tube section to the special bottom head element may comprise a frustoconical shape. Similarly, the bottom of the head element may employ a frustoconical or conical shape to facilitate soil penetration and subsequent aggregate compaction. The leading end of the bulbous bottom head element may include a sacrificial cap member which is fixed to the bottom head element while penetrating the soil matrix upon initial placement of the hollow tube into the soil matrix, to prevent soil from entering the hollow tube. The sacrificial cap may then be released or disengaged from the end of the hollow tube to reveal an end passage when as the hollow tube is first lifted so that aggregate material may be released through the hollow tube and may flow into the cavity which results from lifting the hollow tube.

Alternatively, or in addition, the leading end of the bulbous bottom head element may include an internal mechanical valve that is closed during initial penetration of the soil matrix by the hollow tube and bulbous bottom head element, but which may be opened during lifting to release aggregate material. Other types of leading end valve mechanisms and shapes may be utilized to facilitate initial matrix soil penetration, prevent soil entrance into the hollow tube, permit release of aggregate material when the hollow tube is lifted, and to transmit vector forces in combination with the leading end of the special bottom head element to compact the successive aggregate lifts.

Further, the apparatus may include means for positioning one or more vertical uplift members within the formed pier for subsequent use as a vertical uplift anchor force resistance member, as well as for a tell-tale member within the formed pier for measuring the movement of the bottom of the formed pier upon loading, such as during load testing. Such ancillary features or means may be introduced through the interior of the hollow tube during formation of the pier.

Alternatively, uplift anchor rods or a tell-tale rod or rods may be placed on the outside of the hollow tube and the bulbous bottom head element. Such rods would run longitudinally along the length of the hollow tube and head element and thus be positioned at the side of the cavity formed thereby. One, or two or more rods may be placed in such a manner. The rods placed on the outside of the hollow tube and head element may be employed alone or in combination with such rods initially positioned on the inside of the hollow tube.

As yet another feature of the invention, vibration dampers may be employed in combination with a hopper that feeds aggregate or other material into the hollow tube. Thus, two or more dampers may be used and thus, employed in combination with the driving mechanism.

In another aspect of the invention, the diameter of the hollow tube along its longitudinal length between the hopper or top end of the hollow tube and the bulbous bottom head element may be varied. The largest diameter hollow tube section may be positioned at the top of the hollow tube, with progressively smaller diameter sections below the largest diameter section, the smallest of which is joined to the bottom head element. This arrangement can effect reduction in total weight of the hollow tube, while increasing the strength in those portions of the hollow tube where greater strength is required. The hollow tube may be assembled in multiple sections which are bolted, welded or otherwise fastened together. The outer configuration of adjacent sections may also be varied, for example, they may have various geometrical cross sectional shapes such as circular, elliptical, hexagonal, etc. The sections may be pre-assembled or assembled by connecting them seriatim during soil penetration.

In the practice of the method of the invention, it may be advantageous to utilize crushed stone which has angular facets or faces rather than rounded or river stone which is more commonly used with other soil improvement methods. The ability to use crushed stone in the practice of the method enables the use of a material not commonly employed for building such piers and, as such, provides the capability to construct a pier having certain practical advantages such as a higher density and a greater stiffness. Nonetheless, rounded or river stone may also be used. Combinations of such stone including crushed stone and rounded or river stone may also be used.

As another feature of the invention, the hollow tube and bulbous bottom head element may be appropriately guided in movement into the soil matrix by means of an alignment guide. The alignment guide provides an additional function of preventing the hollow tube and special bottom head element from displacing laterally ("kicking out") during initial penetration into the soil matrix. One example of a special alignment guide is a toroidal guide member encircling the hollow tube and fastened to the drive machine to provide for guidance thereof for the hollow tube and bulbous bottom head element.

Other forms of special alignment guides can be utilized and more than one alignment guide may be utilized.

As yet another feature, the hollow tube and bulbous bottom head element may be forced or driven into a soil matrix by means of a vibratory hammer which is fastened thereto by means of a lock plate construction. The lock plate is held in position by bolts or rods which are retained by special lock washers, for example, the special lock washers having the commercial name "Northlock Washers". This arrangement reduces the electricity created between the driving apparatus and the hollow tube with bulbous bottom head element.

The typical exterior diameter of a circular cross section embodiment of the special bottom head element is in the range of about 14 inches. Other typical sizes in terms of the diameter of the head element include a head element having a diameter of anywhere from 12 to 16 inches and the range of the practicable diameters of a head element may be from about 10 to about 20 inches. This differs from other tubular apparatus for soil improvement which typically are larger, from 24 to 36 inches in diameter. The shape of the head element in cross section is typically cylindrical, although other shapes may be utilized to provide the relative bulbous shape of the bulbous bottom head element when contrasted with the cross sectional area of the hollow tube section attached thereto.

A sensor device may be attached to the bulbous bottom head element to measure the vertical force over time as encountered by the bulbous bottom head element during the vertical compaction and lateral displacement of aggregate process. The sensor device enables measurement of the vertical force and the duration of vertical force being placed thereon. The sensor device can be attached to the bulbous bottom head element, for example, just above the lower shaped portion thereof to provide axial and transaxial readings.

As another feature, the apparatus of the invention may be used in combination with aggregate, with cementations grout in combination with aggregate, or with concrete, as well as other pier forming materials.

As another feature, the apparatus and method of the invention may be utilized in stiff, very stiff, medium dense or hard soils. In certain circumstances, one may pre-drill at least in part the soil at a pier location. Alternatively, it is possible to pre-penetrate the soil at a pier location with a special designed penetration head element fastened to a shaft. The cross sectional area of the shaft is typically less than the maximum cross sectional area of the penetration head element. The maximum diameter of the penetration head element is typically less than the diameter of the bulbous bottom head element attached to the elongate hollow tube. A conical penetration head on a shaft is an effective shape for the special designed penetration head element, although other configurations may be used. The operation of the pre-penetration step is prior to and typically separate from the steps of installing the pier by means of the hollow tube and bulbous bottom head element.

As another feature of the invention, aggregate piers made in accord with the apparatus and method of the invention may be installed at a depth beneath a soil surface. The aggregate pier may then serve as a base or support for an alternative type of pier construction. Thus, two or more different types of pier segments, one of which is the system described herein, may be joined or coupled or stacked to form a single pier.

The discharge opening at the extreme distal end of the bulbous bottom head element may vary in size. Typically, since the bottom head element is utilized to discharge aggregate or other similar material from an opening, then a portion of the extreme distal end of the bulbous bottom head element will comprise a generally horizontal structure coupled with a conical or generally conical surface. The bottom opening will typically comprise less than fifty percent of the surface area of the generally horizontal portion or section and the generally conical surface portion. The horizontal bottom portion and the generally conical portion impart forces directly onto aggregate released or discharged from the bottom opening.

Thus, it is an object of this invention to provide a hollow tube apparatus with a special design, larger effective diameter than the hollow tube, bulbous bottom head element useful to create a compacted aggregate pier, with or without additives, that extend to a greater depth and to provide an improved method for creating a pier which extends to a greater depth than typically enabled or practiced by known, existing short aggregate pier technology.

Yet another object of the invention is to provide an improved method and apparatus for forming a pier of compacted aggregate material that does not require the use of temporary steel casing during the pier formation process, particularly in soils susceptible to caving in such as sandy soils and soils below the ground water table.

Yet another object of the invention is to provide an improved method and apparatus for forming a pier of compacted aggregate material that may include a multiplicity of optional additives, including a mix of aggregate, the addition of water, the addition of dry cement, the addition of cementitious grout, the addition of water-cement-sand, the addition of fly-ash, the addition of hydrated lime or quicklime, and the addition of other types of additives, including the use of concrete, to improve the engineering properties of the matrix soil, of the aggregate materials and of the formed pier.

Yet a further object of the invention is to provide an aggregate material pier construction which is capable of being installed in many types of soil and which is further capable of being formed at greater depths and at greater speeds of construction than known prior aggregate pier constructions.

Yet a further object of the invention is to provide an improved method and apparatus for forming a pier of compacted aggregate material within a softened or loosened aggregate pier previously formed by different pier construction process and with different apparatus than that described herein in order to stabilize and stiffen the previously formed pier.

Another object of the invention is to provide a pier forming apparatus useful for quickly and efficiently constructing compacted multi-lift aggregate piers and/or aggregate piers comprised of as few as a single lift.

These and other objects, advantages and features of the invention will be set forth in the detailed description which follows.

BRIEF DESCRIPTION OF THE DRAWINGS

In the detailed description which follows, reference will be made to the drawing comprised of the following figures:

FIG. 1 is a schematic view of a hollow tube with a special bottom head element being pushed, forced or driven into soil by a vertical, static vector force and optional dynamic forces;

FIG. 2 is a schematic view of a subsequent step from FIG. 1 wherein aggregate material is placed into a hopper and fed into the hollow tube. Hopper may also be detached from the hollow tube and placed on the ground rather than on top of the hollow tube;

FIG. 3 is a cross sectional view of a hopper that has double two or more isolation dampers and may be used in combination with the hollow tube;

FIG. 3A is a sectional, isometric view of the hopper and hollow tube of FIG. 3;

FIG. 3B is an isometric view of the hopper and hollow tube of FIG. 3;

FIG. 4 is a cross sectional schematic view of a hollow tube having an internal pinch or check valve;

FIG. 9 is a schematic view wherein the hollow tube and its associated special bottom head element provide a vertical, static vector force with optional dynamic forces to move the hollow tube and bulbous bottom head element downward a predetermined distance by impacting and compacting the aggregate material released from the hollow tube and by pushing a portion of the aggregate material laterally into the soil matrix;

FIG. 10 is a schematic view of the hollow tube and its special bottom head element being lifted a predetermined distance to form a second lift;

FIG. 11 is a schematic view of the hollow tube and bulbous bottom head element operating to provide a vertical vector force to move the hollow tube and bulbous bottom head element downward a predetermined distance to form the second compacted lift on the top of a first compacted lift;

FIG. 12 is a schematic view of the hollow tube with an optional reinforcing steel rod element or tell-tale element attached to a plate for installation inside of a formed aggregate pier;

FIG. 13 is a schematic view of the hollow tube wherein optional water or water-cement-sand grout, or other additive is combined with aggregate in the hollow tube;

FIG. 14 is a vertical cross sectional view of the special bottom head element with a trap door-type bottom valve;

FIG. 15 is a cross sectional view of the bulbous bottom head element of FIG. 14 taken along the line 15-15;

FIG. 15A is a cross sectional view of a portion of an alternative bulbous bottom head element of the type depicted in FIG. 14;

FIG. 16 is a cross sectional view of the special bottom head element including a sacrificial cap at the lower end similar to FIG. 8A;

FIG. 17 is a cross sectional view of the special bottom head element with an optional uplift anchor member or tell-tale member attached to a plate;

FIG. 18 is a cross sectional view of a partially formed multiple lift aggregate pier formed by the hollow tube and special bottom head element and method of the invention;

FIG. 19 is a cross sectional view of a completely formed multiple lift aggregate pier formed by hollow tube and special bottom head element and method of the invention;

FIG. 27 is a diagrammatic view illustrating the incorporation of two or more uplift or tell-tale rods external to the hollow tube and attached bottom plate or sacrificial cap;

FIG. 27A is a lateral side view of the construction of FIG. 27;

FIG. 27B is a bottom plan view of the construction of FIG. 27;

FIG. 28 is a diagrammatic view illustrating apparatus incorporating different cross sectional area sections of a hollow elongate tube in combination with a bulbous bottom head element;

FIG. 29 is a diagrammatic view of an aggregate pier which incorporates uplift anchors;

FIG. 30 is a diagrammatic view of an aggregate pier made in accord with the invention which incorporates tell-tale rods utilized for the conduct of load tests;

FIG. 31 is a diagrammatic view of an embodiment of the invention apparatus for aligning the hollow tube and bulbous bottom head upon for insertion into a soil matrix;

FIG. 32 is a diagrammatic view of a bulbous bottom head element incorporating a sensor device for measuring force or pressure over time during the making of an aggregate pier;

FIG. 33 is an exploded diagrammatic view of apparatus for attachment of a vibratory hammer to a hollow tube in order to effect positioning of the hollow tube and bulbous bottom head element into a soil matrix;

FIG. 34 is a diagrammatic view of a soil matrix pre-penetration device which may be used in combination with apparatus comprising an embodiment of the invention;

FIG. 35 is a diagrammatic view of a pier comprised of a composite of pier sections made in accord with a method of the invention in combination with other methods to result in a new combination;

FIG. 36 is a bottom end view of a bulbous bottom head element depicting the orifice or opening at the extreme distal end thereof for the passage of aggregate and/or other material;

DESCRIPTION OF THE EMBODIMENTS OF THE INVENTION

Figure 5:
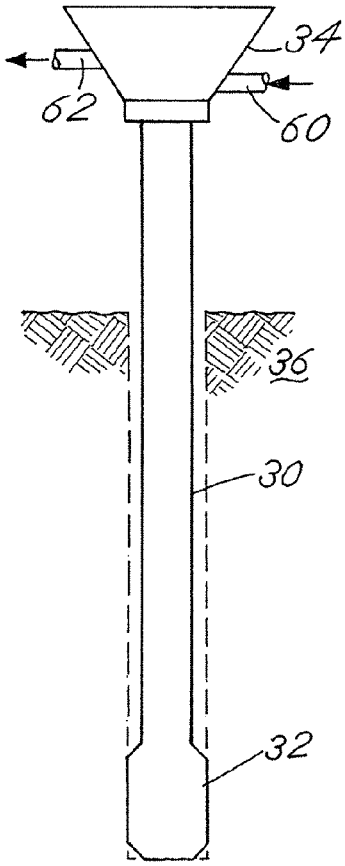
FIG. 5 is a schematic view depicting the step of optional introduction of water, cementatious grout or other additive material into the hollow tube with recirculation provided to a water or grout reservoir. Additive materials may also be introduced directly into the hollow tube.

General Construction:

FIGS. 1, 2, 5, 6, 7, 9, 10, 11, 12, 13, 18, 19, 20 and 23-26 illustrate the general overall method of construction of the pier forming device or mechanism and various as well as alternative sequential steps in the performance of the method of the invention that produce the resultant aggregate pier construction. Referring to FIG. 1, the method is applicable to placement of piers in a soil matrix which requires reinforcement for the soil to become stiffer and/or stronger. A wide variety of soils may require the practice of this invention including, in particular, sandy and clay soils. With the invention, it is possible to construct piers comprised of one or more lifts, utilizing aggregate materials and optionally utilizing aggregate materials with additive materials such as water, cement, sand or grout. The resulting piers have greater stiffness and strength than many prior art aggregate piers, can economically be extended to or built to greater depths than many prior art aggregate piers, can be formed without use of temporary steel casing unlike many prior art aggregate piers, can be installed faster than many prior art aggregate piers, can be installed using less aggregate materials per foot of pier length than many prior art aggregate piers, and can be installed without causing soil matrix spoils from being discharged or accumulating at the ground surface in the vicinity of the top of pier.

As a first step of the method, a hollow tube or hollow shaft 30 having a longitudinal axis 35 including or with a special bottom head element 32, is pushed by a static, axial vector force driving apparatus 37 in FIG. 3 and optionally vertically (axially) vibrated or rammed or both, with dynamic vector forces, into a soil matrix 36. The portion of soil matrix 36, that comprises the volume of material displaced by pushing a length of the hollow tube 30 including the bulbous bottom head element 32, is forced primarily laterally thereby compacting the adjacent soil matrix 36. As shown in FIG. 1, the hollow tube 30 may comprise a cylindrical steel tube 30 having a longitudinal axis 35 and an external diameter in the range of 6 to 14 inches, for example. In the event that a layer of hard or dense soil prevents pushing of the hollow tube 30 and special bottom head element 32 into the soil matrix 36, such hard or dense layer may be pre-drilled, or pre-penetrated, and the pushing process may then continue utilizing the driving apparatus 37.

Typically, the hollow tube 30 has a uniform cylindrical external shape, although other shapes may be utilized. Though the external diameter of the hollow tube 30 is typically 6 to 14 inches, other diameters may be utilized in the practice of the invention. Also, typically, the hollow tube 30 will be extended or pushed into the soil matrix 36 to the ultimate depth of the aggregate pier, for example, up to 50 feet or more. The hollow tube 30 will normally fasten to an upper end drive extension 42 which may be gripped by a drive apparatus or mechanism 37 to push and optionally vibrate or ram, the hollow tube 30 into the soil matrix 36. Alternately, as shown in FIG. 33, the hollow tube 30 may be fastened to a base plate 558 and from the base plate to the drive apparatus 556.

FIGS. 3, 3A and 3B illustrate a feature that may be associated with the hopper 34 when the hopper is located at the top of the hollow tube 30. Double isolation dampers 46, 48 are affixed to the upper and lower sides of the hopper 34 to reduce the vibration buildup of the hopper 34 and thereby provide a hopper assembly with greater structural integrity. An extension 42 is affixed to hollow tube 30 to impart the static and dynamic forces on the tube 30. Extension 42 is isolated from hopper 34 and thus is slidable relative to dampers 46, 48.

The hopper 34, which contains a reservoir 43 for aggregate materials, when located at the top of the hollow tube 30, will typically be isolated by the isolation dampers 46, 48 from extension 42. The vibrating or ramming device 37 which is fastened to extension 42 may be supported from a cable or excavator arm or crane. The weight of the hopper 34, ramming or vibrating device 37 (with optional additional weight) and the hollow tube 30 may be sufficient in some matrix soil conditions to provide a static force vector without requiring use of a separate static force drive mechanism. The static force vector may optionally be augmented by a vertically vibrating and/or ramming dynamic force mechanism. Also, the hopper 34 may be separate from the hollow tube 30 and extension 42. For example, a separate hopper not mounted on the top of the hollow tube 30 (not shown) may feed aggregate or other material into the hollow tube 30 along the side of the tube.

FIG. 3(*c*) illustrates the manner of incorporating a copper 34 in combination with a tube for feeding aggregate or other material into a passage formed in the soil matrix. Specifically damper mechanisms 46 and 48 are attached respectively to the hopper 34 and to the feed tube 42. The attachment is effected through an elastic connector 46 and 48 which effectively dampens the forces, particularly laboratory forces that may be imparted to the vertical feed tube 42.

FIG. 4 illustrates an optional feature of the hollow tube 30. A restrictor, pinch valve, check valve or other type of valve mechanism 38 may be installed within the hollow tube 30 or in the special bottom head element or lower end section 32 of the hollow tube 30 to partially or totally close off the internal passageway of the hollow tube 30 and stop or control the flow or movement of aggregate materials 44 and optional additive materials. This valve 48 may be mechanically or hydraulically opened, partially opened or closed in order to control movement of aggregate materials 44 through the hollow tube 30. It may also operate by gravity in the manner of a check valve which opens when raised and closes when lowered onto the aggregate material 44.

FIG. 14 illustrates a construction of the bulbous bottom head element or section 32. The bulbous bottom head element 32 is cylindrical, although other shapes may be utilized. The external diameter of the special bottom head element 32 is greater than the nominal external diameter of the upper section 33 of the hollow tube 30 and is typically 12 to 18 inches, although other diameters and/or cross sectional profiles may be utilized in the practice of the invention. Thus, the head element 32 will have cross sectional dimensions or area greater than that of hollow tube 30 immediately adjacent thereto.

FIGS. 14, 15 and 15A illustrate an embodiment of the invention having a valve mechanism incorporated in the bulbous bottom head element 32. The bulbous bottom head element 32 has a frustoconical bottom section or other shaped, bottom portion 50 with an aggregate material 44 discharge opening 52 that opens and closes as a valve plate 54 exposes or covers the opening 52. The valve plate 54 is mounted on a rod 56 that slides in a hub 59 held in position by radial struts 58 attached to the inside passage walls of the bulbous bottom head element 32 of the hollow tube 30. The plate 54 slides to a closed position when the hollow tube 30 is forced downward into the soil matrix 36 and slides to an open position when hollow tube 30 is raised, thus allowing aggregate material 44 to flow. The opening of valve 54 is controlled or limited by rod 56 which has a head 56*a* that limits sliding movement of rod 56. The hollow tube 30 may thus be driven to a desired depth 81 (FIG. 6) with opening 52 closed by plate 54. Then as the hollow tube 30 is raised (for example, the distance 91 in FIG. 10), the plate 54 extends or moves downwardly due to gravity so that aggregate material 44 will flow through opening 52 into the cavity formed due to the raising of the hollow tube 30. Thereafter, the tube 30 is impacted or driven downwardly closing valve plate 54 and compacting the released material to form a compacted lift 72. In the embodiment of FIGS. 14, 15, 15A the valve plate 54 moves in response to gravity. However, rod 56 may alternatively be replaced or assisted in movement by a fluid drive, mechanical or electrical mechanism. Alternatively, as described hereinafter, the plate 54 may be replaced by a sacrificial cap 64 or by the bottom plate of an uplift anchor or a tell-tale mechanism 70 as described hereinafter. Also, the check valve 38 in FIG. 4 may be utilized in place of the valve mechanism depicted in FIGS. 14, 15, 15A.

Typically, the internal diameter of the hollow tube 30 and head element 32 are uniform or equal, though the external diameter of the bulbous bottom head element 32 is greater than that of hollow tube 30. Alternatively, when a valve mechanism 54 is utilized, the internal diameter of the head element 32 may be greater than the internal diameter of the hollow tube 30. Bulbous bottom head element 32 may be integral with hollow tube 30 or formed separately and bolted or welded onto hollow tube 30. Typically, the inside diameter of the hollow tube 30 is between 6 to 10 inches and the external diameter of the special bottom head element 32 is about typically 12 to 18 inches. The opening diameter 53 in FIG. 14 at the extreme lower end or leading end of the special bottom head element 32 may be equal to or less than the internal diameter of the head element 32. For example, referring to FIG. 14, the head element 32 may have an internal diameter of 12 inches and the opening diameter 53 may be 6 to 10 inches, while in FIG. 16, with the sacrificial cap embodiment described hereinafter, the discharge opening of head element 32 has the same diameter as the internal diameter of the head element 32 and hollow tube 30.

Also the plate or valve 54 may be configured to facilitate closure when the hollow tube 30 is pushed downward into the soil matrix 36 or against aggregate material 44 in the formed cavity. For example, the diameter of member 54 may exceed that of opening 52 as shown in FIG. 14 or the edge 55 of the valve member may be beveled as depicted in FIG. 15A to engage beveled edge 59 of opening 52. Then when applying a static or other downward force to the hollow tube 30, the valve plate 54 will be held in a closed position relative to opening 52.

The lower bulbous bottom head element 32 of hollow tube 30 typically has a length in the range of one to three times its diameter or maximum lateral dimension. The bulbous bottom head element 32 provides enhanced lateral compaction forces on the soil matrix 36 as tube 30 penetrates or is forced into the soil and thus renders easier the subsequent passage of the lesser diameter section 33 of the hollow tube 30. The frusto-conical or inclined leading and trailing edges 50, 63 of the head element 32 facilitate lowering or driving penetration and lateral compaction of the soil 36 because of their profile design. The trailing inclined section or edge 63 in FIG. 14 facilitates the raising of the hollow tube 30 and head element 32 and lateral compaction of soil matrix 36 during the raising step of the method. Again, the shape or inclined configuration of bulbous bottom head element 32 enables this to occur. Typically the leading and trailing edges 50, 63 form a 45°±15° angle with the longitudinal axis 35 of the hollow tube 30.

FIG. 5 illustrates another feature of the hollow tube 30. Inlet port 60 and outlet port 62 are provided at the lower portion of the elevated hopper 34 or the upper end of hollow tube 30 to allow addition of water or of grout, such as water-cement-sand grout, as an additive to the aggregate for special pier constructions. A purpose of the outlet port 62 is to maintain the water or additive level where it will be effective to facilitate flow of aggregate and also to allow recirculation of the grout from a reservoir back into the reservoir to facilitate mixing and to keep the water head or grout head (pressure) relatively constant. The inlet port 60 and outlet port 62 may lead directly into the hopper 34 or directly into the hollow tube 30 (see FIG. 13), or may connect with separate channels or conduits to the bulbous bottom head element 32. Grout discharge openings 31 may be provided through hollow tube 30 above bulbous bottom head element 32 as shown in FIG. 2 to supplement discharge of grout into the annular space about hollow tube 30 and prevent cavity fill in by soil from the matrix 36.

FIGS. 8A, 8B, 8C and 16 illustrate another alternate feature of the bulbous bottom head element 32. A sacrificial cap 64 may be utilized in lieu of the bottom or lower end sliding valve 54 to protect the bulbous bottom head element 32 from clogging when the bulbous bottom head element 32 is pushed down through soil matrix 36. The cap 64 may be configured in any of a number of ways. For example, it may be flat, pointed or beveled. It may be arcuate. When beveled, it may form an angle of 45°±25° with respect to horizontal axis 35. Cap 64 may include a number of outwardly biased legs 87 positioned to fit in the central opening 89 of the bulbous bottom head element 32 and hold cap 64 in place until hollow tube 30 is first raised and aggregate 44 caused to flow out the opening 52 into an exposed cavity section.

Figure 20:
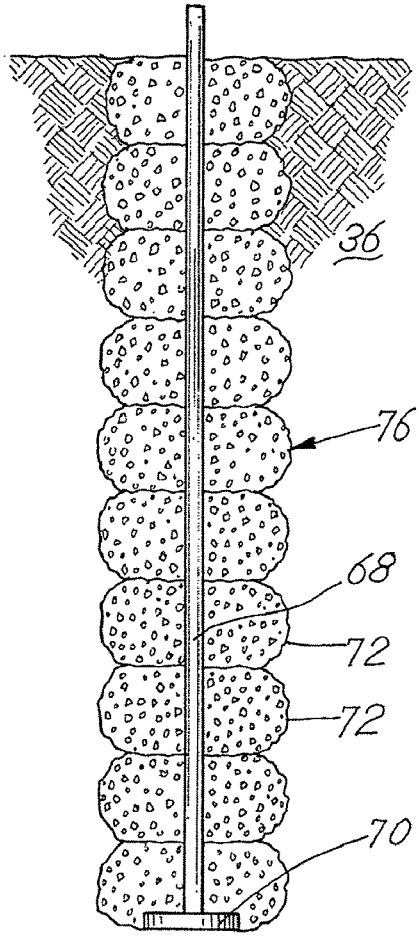
FIG. 20 is a cross sectional view of a formed, multiple lift aggregate pier with an optional reinforcing steel rod having an attached plate which enables the formed pier to comprise an uplift anchor pier or to include a tell-tale element for subsequent load testing.

FIG. 17 illustrates another alternate feature of the bottom head element 32. The sliding plate 54 and rod 68 for support of plate 54 may include a passage or axial tube 57 that allows the placement of a reinforcing element or rod 68 attached to a bottom plate 70. The rod 68 and plate 70 will be released at the bottom of a formed cavity and used to provide an uplift anchor member or a tell-tale member for measuring bottom movement of a pier during a load test. The sliding rod 68 attached to a bottom plate 70 may be substituted for the sacrificial cap 64 closing the opening of the bulbous bottom head element 32 during pushing into the soil matrix 36, and perform as a platform for the uplift anchor member or tell-tale member being installed. The bottom valve plate 54 may thus be omitted or may be kept in place while the uplift anchor or tell-tale elements are being utilized. FIG. 20 illustrates the uplift anchor 68, 70 or tell-tale in place upon the forming of a pier by the invention wherein the plate or valve 54 is omitted.

Figure 6:
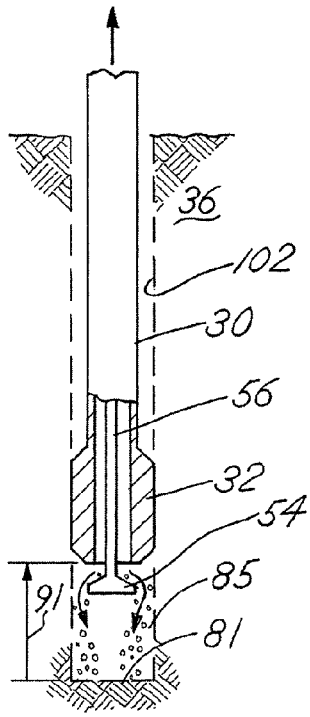
FIG. 6 is a schematic view depicting a step subsequent to the step of FIG. 2 wherein the hollow tube with its bulbous bottom head element are lifted a predetermined distance to temporarily expose a hollow cavity portion in the soil matrix to allow aggregate to quickly fill the exposed hollow cavity portion.

Method of Operation:

FIG. 1 illustrates the typical first step of the operation of the described device or apparatus. The hollow tube 30 with bulbous bottom head element 32 and attached upper extension 42 and connected hopper assembly 34, are pushed with a vertical or axial static vector force, typically augmented by dynamic vector forces, into the soil matrix 36 by drive apparatus 37 or by the weight of the component parts. In practice, utilizing a tube 30 with special bottom head element 32 having the dimensions and configuration described, a vector force of 5 to 20 tons applied thereto is typical throughout. FIG. 2 illustrates placing of aggregate 44 into the hopper 34 when the hollow tube 30 and attachments reach the planned depth 81 of pier into the soil matrix 36. FIG. 6 illustrates subsequent upward or lifting movement of the hollow tube 30 by a predetermined lifting distance 91, typically 24 to 48 inches to reveal a portion of unshielded cavity 102 below the lower section head element 32 in the soil matrix 36.

Figure 7:
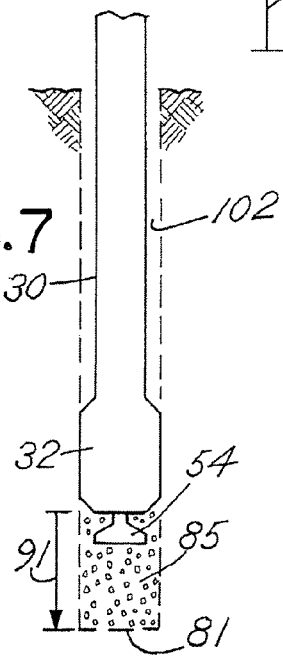
FIG. 7 is a schematic view of the process step subsequent to FIG. 6 wherein a bottom valve in the bottom portion of the hollow tube is opened releasing aggregate into an unshielded, hollow cavity section.
Figure 8A:
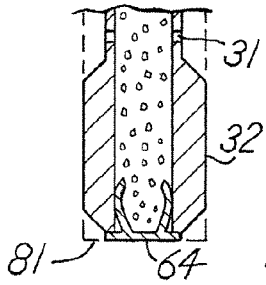
FIGS. 8A and 8B are schematic cross sectional views of an alternative to the device and step represented or illustrated in FIG. 7 wherein the bulbous bottom head element of the hollow tube includes a sacrificial cap which is released into the bottom of a formed cavity when the hollow tube and special bottom head element are raised a predetermined distance, as shown in FIG. 8B.
Figure 8B:
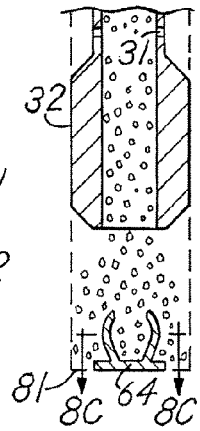
Figure 8C:
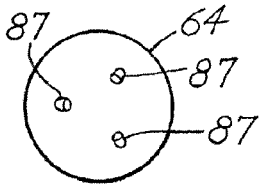
FIG. 8C is a sectional view of the sacrificial cap of FIG. 8B taken along the line 8C-8C in FIG. 8B.

FIG. 7 illustrates opening of the bottom valve 54 to allow aggregate 44 and optional additives to fill the space or portion 85 of cavity 102 below the bulbous bottom head element 32 while the hollow tube 30 and attachments are being raised. The valve 54 may open as the hollow tube 30 is lifted due to weight of aggregate 44 on the top side of valve 54. Alternatively, valve 54 may be actuated by a hydraulic mechanism for example, or the hollow tube 30 may be raised and aggregate then added to flow through valve opening 53 by operation of valve 54. Alternatively, internal valve 38 may be opened during lifting or after lifting. Alternatively, if there is no valve 54, the sacrificial cap 64 will be released from the end of the head element 32, generally by force exerted by the weight of aggregate material 44 directed through the hollow tube 30 when the bulbous bottom head element 32 is raised a predetermined distance from the bottom 81 of the formed pier cavity 102.

FIG. 9 illustrates the subsequent pushing downward of the hollow tube 30 and attachments and closing of the bottom valve 54 to compact the aggregate 44 in the cavity portion 85 thereby forcing the aggregate 44 and optional additives laterally into the soil matrix 36 as well as vertically downward. The predetermined movement distance for pushing downward is typically equal to the lifting distance 91 minus one foot, in order to produce a completed lift 72 thickness of one foot following the predetermined lifting distance 91 of hollow tube 30. The designed thickness of lift 72 may be different than one foot depending on the specific formed aggregate pier requirements and the engineering characteristics of the soil matrix 36 and aggregate 44. Compacting the aggregate material 44 released into the vacated, unshielded cavity portion 85 in FIG. 7 to effect lateral movement of the aggregate material 44 horizontally as well as compaction of the aggregate material vertically is important in the practice of the invention.

FIG. 10 illustrates the next or second lift formation effected by lifting of the hollow tube 30 and attachments another predetermined distance 91A, typically 24 to 48 inches to allow opening of the bottom valve 54 (in the event of utilization of the embodiment using valve 54) and passage or movement of aggregate 44 and optional additives into the portion of the cavity 85A that has been opened or exposed by raising tube 30.

Raising of the hollow tube in the range of two (2) to four (4) feet is typical followed by lowering (as described below) to form an aggregate pier lift 72, having a one (1) foot vertical dimension is typical for pier forming materials as described herein. The axial dimension of the lift 72 may thus be in the range of ¾ to ⅕ of the distance 91 the hollow tube 30 is raised. However, the embodiment depicted in FIGS. 23-26 constitutes an alternate compaction protocol.

FIG. 11 illustrates pushing down of the hollow tube 30 and attachments and closing of the bottom valve 54 to compact the aggregate 44 in the newly exposed, unshielded cavity portion 85A of FIG. 10 and forcing of aggregate 44 and optional additives laterally into the soil matrix 36. The distance of pushing will be equal to the distance of lifting minus the designed lift thickness. When the sacrificial cap 64 method is utilized, the bottom opening 50 may remain open while compacting the aggregate 44.

Figure 21:
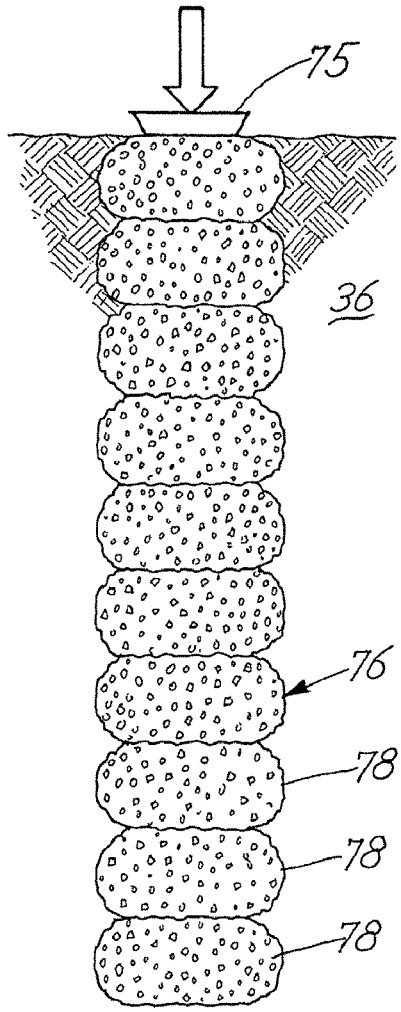
FIG. 21 is a cross sectional view of formed aggregate pier being preloaded or having an indicator modulus load test being performed on the completed pier.

FIG. 18 illustrates an aggregate pier partially formed by the process described wherein multiple lifts 72 have been formed sequentially by compaction and the hollow tube 30 is rising as aggregate 44 is filling cavity portion 85X. FIG. 19 illustrates a completely formed aggregate pier 76 by the process described. FIG. 20 illustrates a formed pier 76 with uplift anchor member 68, 70 or tell-tale member installed. FIG. 21 illustrates an optional preloading step on a formed aggregate pier 76 by placement of a weight 75, for example, on the formed pier and an optional modulus indicator test being performed on the formed aggregate pier 76 comprised of multiple compacted lifts 78.

Figure 23:
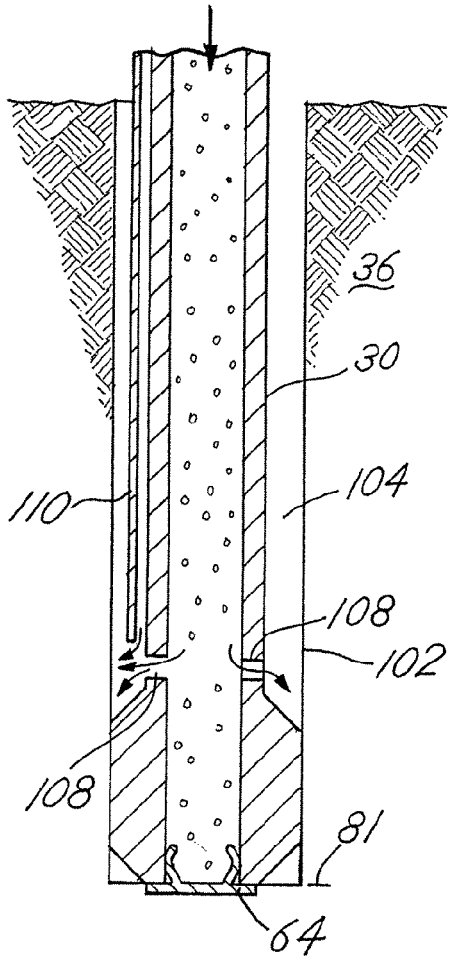
FIG. 23 is a schematic, cross sectional view of a method of use of the apparatus of the invention to form a single lift aggregate pier or an aggregate pier wherein a single lift or an extended lift is first formed to fill the cavity with aggregate and then an optional second step may be performed of re-penetrating into the single lift or extended lift to make subsequent thin lifts.
Figure 24:
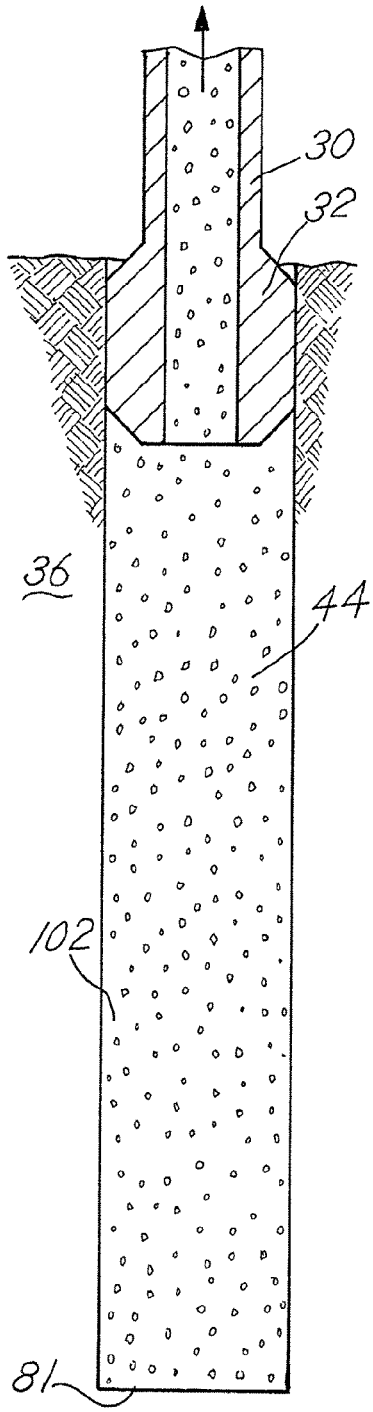
FIG. 24 is a schematic cross sectional view of continuation of the method illustrated by FIG. 23.
Figure 25:
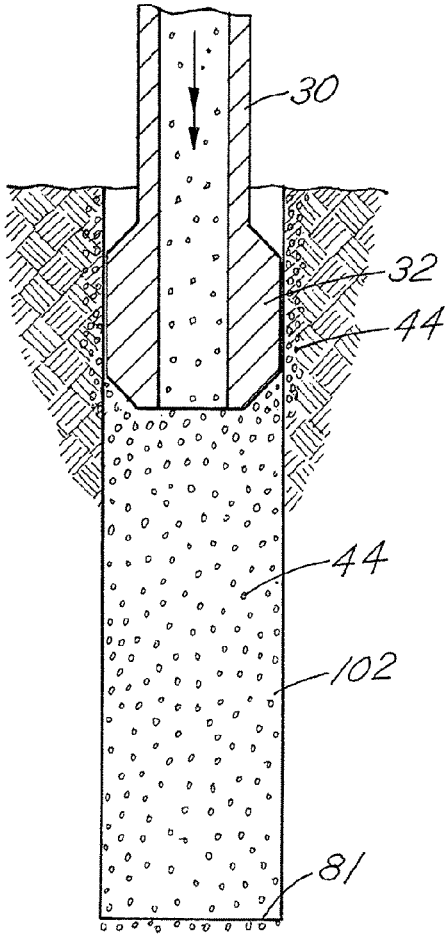
FIG. 25 is a schematic cross sectional view of further continuation of the step depicted in FIG. 24.

FIGS. 23 through 26 illustrate an alternative protocol for the formation of a pier using the described apparatus. The hollow tube 30 is initially forced or driven into a soil matrix 36 to a desired depth 100. The extreme bottom end of the head element 32 includes a valve mechanism 54, sacrificial cap 64 or the like. Forcing the hollow tube 30 vertically downward in the soil forms a cavity 102 (FIG. 23). Assuming the special bottom head element 32 is generally cylindrical, cavity 102 is generally cylindrical, and may or may not maintain the full diameter configuration associated with the shape and diameter of special bottom head element 32.

Upon reaching the desired penetration into the matrix soil 36 (FIG. 23) and having displaced and densified the matrix soils that previously existed within the formed cavity, the hollow tube 30 is raised to the top of the formed cavity or to the top of the planned aggregate pier (FIG. 24) in a single lift. As it is raised, aggregate material 44 and optional additive materials are discharged below the bottom end of the special bottom head element 32.

Optionally, additive materials are discharged into the annular space 104 defined between the upper section 33 of hollow tube 30 and the interior walls of the formed cavity 102. The additive materials may flow through ancillary lateral passages 108 or supplemental conduits 110 in the hollow tube 30. As the hollow tube 30 is raised, the cavity 102 is filled with aggregate and optionally, additive materials. Also, additive materials in the annular space 104 may be forced outwardly into the soil matrix 36 by and due to the configuration of the bulbous bottom head element 32 as it is raised.

The hollow tube 30 is thus typically raised substantially the full length of the initially formed cavity 102 and then, as depicted by FIG. 25, again may be forced downward causing the aggregate material in the cavity 102 to be compacted and a portion of the aggregate materials to be forced laterally into the soil matrix 36 (FIG. 25). The extent of downward movement of the hollow tube 30 is dependent on various factors including the size and shape of the cavity 102, the composition and mix of aggregate materials and additives, the forces imparted on the hollow tube 30, and the characteristics of the soil matrix 36. Typically, the downward movement is continued until the lower end or bottom of the special bottom head element 32 is at or close to the bottom 81 of the previously formed cavity 102 or until essential refusal of downward movement occurs.

Figure 26:
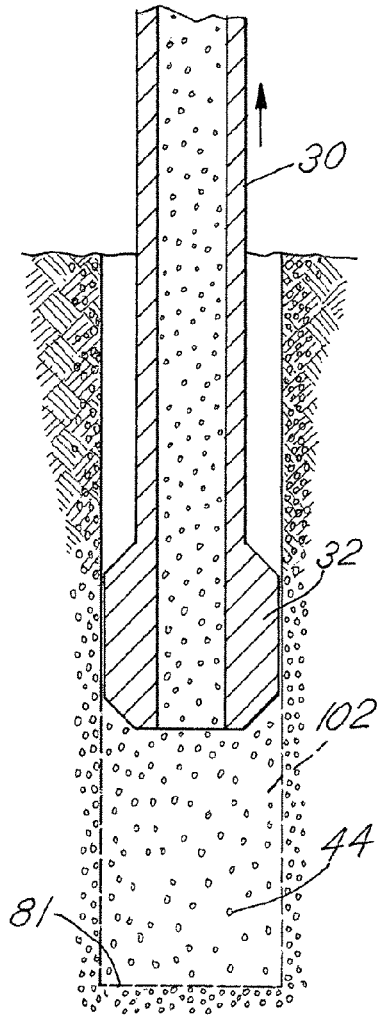
FIG. 26 is a schematic cross sectional view of the further continuation of the method illustrated by FIGS. 22-24.

After completion of the second downward movement, the hollow tube 30 is raised typically the full length of the cavity 102, again discharging aggregate and optionally additive materials during the raising, and again filling, the newly created cavity 102A (FIG. 26). The cycle of fully lowering and fully raising is completed at least two times and optionally three or more times, to force more aggregate 44 and optionally additive materials, laterally into the matrix soil 36. Further, the cycling may be adjusted in various patterns such as fully raising and lowering followed by fully raising and partially lowering, or partially raising and fully lowering, and combinations thereof. Alternately, after one of more full cycles of raising of the hollow tube 30 with discharging of aggregate and optionally additive materials, the subsequent operation can be the same or similar to a typical aggregate pier forming sequence as described previously, where each lift is formed by raising and lowering a predetermined distance.

Alternatively, after completion of a single lift, the resulting aggregate pier with or without optional additive materials, further steps of re-entry of hollow tube 30 and bulbous bottom head element 32 into the formed single lift aggregate pier, may be eliminated. In other words, the apparatus may be used to form a single elongate pier within the soil matrix extending the vertical length of soil penetration. The single lift aggregate pier with densified adjacent matrix soils may be effective without further strengthening or stiffening. One situation in which a single lift aggregate pier will typically be effective is in liquefaction mitigate during seismic events when the matrix soils are liquefiable.

Summary Considerations:

Water or grout or other liquid may be utilized to facilitate flow and feeding of aggregate material 44 through hollow tube 30. The water may be fed directly into the hollow tube 30 or through the hopper 34. It may be under pressure or a head may be provided by using the hopper 34 as a reservoir. The water, grout or other liquid thus enables efficient flow of aggregate, particularly in the small diameter hollow tube 30, i.e. 5 to 10 inches tube 30 diameter. Typically the size of the tube 30 internal passage and/or discharge opening is at least 4.0 times the maximum aggregate size for all the described embodiments. With each lift 72 being about 12 inches in vertical height and the internal diameter of tube 30 being about 6 to 10 inches, use of water as a lubricant is especially desirable.

It is noted that the diameter of the cavity 102 formed in the matrix soil 36 is relatively less than many alternative pier forming techniques. The method of utilizing a relatively small diameter cavity 102 or a small dimension opening into the soil matrix 36, enables forcing or driving a tube 30 to a significant depth and subsequent formation of a pier having horizontal dimensions measurably greater than the external dimensions of the tube 30. Utilization of aggregate 44 with or without additives including fluid materials, to form one or more lifts by compaction and horizontal displacement is thus enabled by the hollow tube 30 and special bottom head element 32 as described. Lifts 72 are compacted vertically and aggregate 44 forced transaxially with the result of a highly coherent pier construction and production of a stiffer and stronger aggregate pier with a larger diameter than its original cavity diameter.

Figure 22:
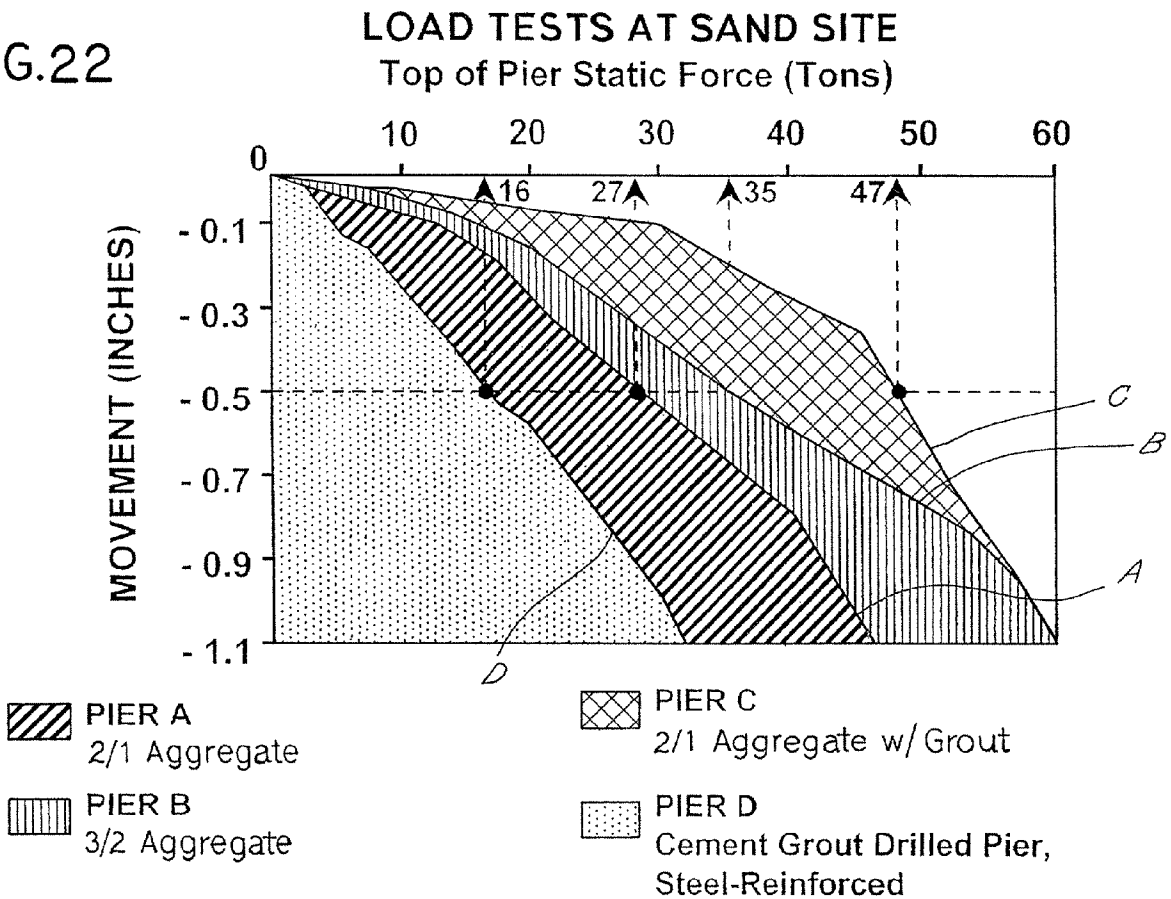
FIG. 22 is a graph illustrating comparative load test plots of the present invention compared with a drilled concrete pile in the same soil matrix formation.

Test Results:

FIG. 22 illustrates the results of testing of piers of the present invention as contrasted with a drilled concrete pier. The graph illustrates the movements of three aggregate piers constructed in accordance with the invention (curves A, B, C) with a prior art drilled concrete pier (curve D), as the piers are loaded with increasing loads to maximum loads and then decreasing loads to zero load. The tests were conducted using the following test conditions and using a steel-reinforced, drilled concrete pier as the control test pier.

A hole or cavity of approximately 8-inches in diameter was drilled to a depth of 20 feet and filled with concrete to form a drilled concrete pier (test D). A steel reinforcing bar was placed in the center of the drilled concrete pier to provide structural integrity. A cardboard cylindrical form 12 inches in diameter was placed in the upper portion of the pier to facilitate subsequent compressive load testing. The matrix soil for all four tests was a fine to medium sand of medium density with standard Penetration Blow Counts (SPT's) ranging from 3 to 17 blows per foot. Groundwater was located at a depth of approximately 10 feet below the ground surface.

The aggregate piers of the invention, reported as in tests A, B, and C, were made with a hollow tube 30, six (6) inches in external diameter and with a special bottom head element 32 with an external diameter of 10 inches. Tests A and B utilized aggregate only. Test C utilized aggregate and cementatious grout. Test A utilized predetermined lifting movements of two feet and predetermined downward pushing movements of one foot resulting in a plurality of one foot lifts. Test B utilized predetermined upward movements of three feet and predetermined downward pushing movements of two feet, again resulting in one foot lifts. Test C utilized predetermined upward movements of two feet and predetermined downward pushing movements of one foot, and included addition of cementatious grout.

Analyses of the data can be related to stiffness or modulus of the piers constructed. At a deflection of 0.5 inches, test A corresponded to a load of 27 tons, test B corresponded to a load of 35 tons, test C corresponded to a load of 47 tons and test D corresponded to a load of 16 tons. Thus at this amount of deflection (0.5 inches) and using test B as the standard test and basis for comparison, ratios of relative stiffness for test B is 1.0, test A is 0.77, Test C is 1.34, and Test D is 0.46. The standard, Test B, is 2.19 times stiffer than the control test pier, Test D. The standard Test B is 1.30 times stiffer than Test A, whereas the Test C with grout additive is 2.94 times stiffer than the prior art concrete pier (Test D). This illustrates that the modulus of the piers formed by the invention are substantially superior to the modulus of the drilled, steel-reinforced concrete pier (Test D). These tests also illustrate that the process of three feet lifting movement with two feet downward pushing movement was superior to the process of two feet lifting movement and one foot downward pushing movement. The tests also illustrate that use of cementations grout additive substantially improved the stiffness of the formed pier for deflections less than about 0.75 inches, but did not substantially improve the stiffness of the formed pier compared with Test B for deflections greater than about 0.9 inches.

In the embodiment disclosed, because the bulbous bottom head element 32 of the hollow tube or hollow shaft 30 has a greater cross sectional area, various advantages result. First the configuration of the apparatus, when using a bottom valve mechanism 54, reduces the chance that aggregate material will become clogged in the apparatus during the formation of the cavity 102 in the soil matrix 36 as well as when the hollow tube 30 is withdrawn partially from the soil matrix 36 to expose or form a cavity 85 within the soil matrix 36. Further, the configuration allows additional energy from static force vectors and dynamic force vectors to be imparted through the bottom head element 32 of the apparatus and impinge upon aggregate 44 in the cavity 70. Another advantage is that the friction of the hollow tube 30 on the side of the formed cavity 102 in the ground is reduced due to the effective diameter of the hollow tube 30 being less than the effective diameter of the bottom head element 32 and therefore being less than the initial diameter of the formed cavity. This permits quicker pushing into the soil and allows pushing through formations that might be considered to be more firm or rigid. The larger cross sectional area head element 32 also enhances the ability to provide a cavity section 102 sized for receipt of aggregate 44 which has a larger volume than would be associated with the remainder of the hollow shaft 30 thus providing for additional material for receipt of both longitudinal (or axial) and transverse (or transaxial) forces when forming the lift 72. The reduced friction of the hollow tube 30 on the side of the formed cavity 102 in the soil 36 also provides the advantage of more easily raising the hollow tube 30 during pier formation and prevention of the hollow tube 30 becoming stuck within the soil matrix.

In the process of the invention, the lowest lift 72 may be formed with a larger effective diameter and have a different amount of aggregate provided therein. Thus the lower lift 72 or lowest lift in the pier 76 may be configured to have a larger transverse cross section as well as a greater depth when forming a base for the pier 76. By way of example the lowest portion or lowest lift 72 may be created by lifting of the hollow shaft 30 four feet and then lowering the hollow tube 30 three feet, thus reducing the height of the lift 72 to one foot, whereas subsequent lifts 72 may be created by raising the hollow shaft 30 three feet and then lowering the hollow tube 30 two feet, thus reducing the thickness of the lift 72 to one foot.

The completed aggregate pier 76 may, as mentioned heretofore, be preloaded after it has been formed by applying a static load or a dynamic load 75 at the top of the pier 76 for a set period of time (see FIG. 21). Thus a load 75 may be applied to the top of the aggregate pier 76 for a period of time from 15 seconds to 15 minutes, or longer. This application of force may also provide a "modulus indicator test" inasmuch as a static load 75 applied to the top of the pier 76 can be accompanied by measurement of the deflection accruing under the static load 75. The modulus indicator test may be incorporated into the preload of each pier to accomplish two purposes with one activity; namely, (1) applying a preload; and (2) performing a modulus indicator test.

The aggregate material 44 which is utilized in the making of the pier 76 may be varied. That is, clean aggregate stone may be placed into a cavity 85. Such stone may have a nominal size of 40 mm diameter with fewer than 5% having a nominal diameter of less than 2 mm. Subsequently a grout may be introduced into the formed material as described above. The grout may be introduced simultaneous with the introduction of the aggregate 44 or prior or subsequent thereto.

When a vibration frequency is utilized to impart a dynamic force, the vibration frequency of the force imparted upon the hollow shaft or hollow tube 30 is preferably in a range between 300 and 3000 cycles per minute. The ratio of the various diameters of the hollow tube or shaft 30 to the bulbous bottom head element 32 is typically in the range of 0.92 to 0.50. As previously mentioned, the angle of the bottom bevel may typically be between 30° and 60° relative to a longitudinal axis 35.

As a further feature of the invention, the method for forming a pier may be performed by inserting the hollow tube 30 with the bulbous bottom head element 32 to the total depth 81 of the intended pier. Subsequently, the hollow tube 30 and bulbous bottom head element 32 will be raised the full length of the intended pier in a continuous motion as aggregate and/or grout or other liquid are being released or injected into the cavity as the hollow tube 30 and special bottom head element 32 are lifted. Subsequently, upon reaching the top of the intended pier, the hollow tube 30 and special bottom head element 32 can again be statically pushed and optionally augmented by vertically vibrating and/or ramming dynamic force mechanism downward toward or to the bottom of the pier in formation. The aggregate 44 and/or grout or other material filling the cavity as previously discharged will be moved transaxially into the soil matrix as it is displaced by the downwardly moving hollow tube 30 and special bottom head element 32. The process may then be repeated with the hollow tube 30 and special bottom head element 32 raised either to the remaining length or depth of the intended pier or a lesser length in each instance with aggregate and/or liquid material filling in the newly created cavity as the hollow tube 30 is lifted. In this manner, the material forming the pier may comprise one lift or a series of lifts with extra aggregate material and optional grout and/or other additives transferred laterally to the sides of the hollow cavity into the soil matrix. Alternatively, the last sequence can be the same or similar to the "typical" aggregate pier forming method of this invention, whereas thin lifts are formed by raising and lowering the hollow tube 30.

It is noted that the mechanism for implementing the aforesaid procedures and methods may operate in an accelerated manner. Driving the hollow tube 30 and bulbous bottom head element 32 downwardly may be effected rather quickly, for example, in a matter of two minutes or less. Raising the hollow tube 30 and bulbous bottom head element 32 incrementally a partial or full distance within the formed cavity may take even less time, depending upon the distance of the lifting movement and rate of lifting. Thus, the aggregate pier is formed from the soil matrix 36 within a few minutes. The rate of production associated with the methodology and the apparatus of the invention is therefore significantly faster.

Additional Features:

FIGS. 27 through 36 illustrate additional features and embodiments of the invention. Referring to FIGS. 27, 27A and 27B, there is illustrated diagrammatically, an apparatus including a hollow tube 500 coupled to a bulbous bottom head element 502. The bulbous bottom head element 502 includes central body 501 which is generally cylindrical with a frustoconical or conical shaped downwardly and inwardly inclined section or surface 504 surface joined to a generally horizontal section or surface 505 with an opening 506 therethrough for passage of materials such as aggregate material, cementations material, grout or combinations thereof. A separate horizontal plate 508 with generally vertically extending rods 510 and 512 is positioned against closure cap 508*a* fitted against surface 505. The rods 510 and 512 fit along the outside of the combination of hollow tube 500 and bottom head element 502. The plate 508 may be in the form of a bar reinforced by angled plates 508B and 508C. Plate 508 engages circular cap or plate 503 which includes vertical pegs 511 that align plate 508 with opening 506 covering the opening 506 or in the form of a grid or other generally horizontal element which is transported during placement of the hollow tube 500 and bulbous bottom head element 502 downwardly into the soil during the initial penetration of the soil matrix. Then upon withdrawal of hollow tube 500 and head element 502, the plate 508 and rods 510 and 512 as well as cap 503 will remain in place at the bottom end of the pier in formation. The rods, such as the rods 510 and 512, may, as shown in FIG. 29, serve as an uplift anchor or as depicted in FIG. 30, may serve as tell-tale rods for load testing. Thus, as depicted in FIGS. 29 and 30, the tell-tale rods 510 and 512 in combination with the lower connecting plate member 508 contemplate positioning of the described assembly on the outside of the hollow tube 500 and bulbous bottom head element 502, yet are enabled to be positioned under the lower end of a formed aggregate pier such as pier 520 in FIG. 29 or pier 522 in FIG. 30.

FIG. 28 depicts a variation of the apparatus which may be utilized for the practice of the invention. In this alternative apparatus, a hollow tube 526 is comprised of a series of connected or bolted tube sections 528, 530 and 532, which extend longitudinally from an elevated hopper 534 or they may extend longitudinally directly from the hollow tube. The smaller cross sectional portion of the hollow tube 526 is connected to the bulbous bottom head element 536. In this manner, the overall weight of the hollow tube section can be reduced, yet the bulbous bottom head element 536 will provide an adequate means and an adequate diameter for penetration into a soil matrix. The hollow tube 526 will also provide an adequate channel for the passage of aggregate, crushed stone, rounded stone, crushed concrete, grout, cementatious material, or other pier forming materials, or combinations thereof.

Numerous variations of the multiple section hollow tube may be practiced, although the typical sequence is for sections to decrease in cross sectional area from top to bottom. Example variations include sections that increase in traverse cross sectional area toward the top end of the hollow tube. The sections may increase in traverse cross sectional area and then decrease. They may have the same traverse cross sectional area but distinct cross sectional configurations. They may be integrally connected or detachable sections. Combinations of these described features may be used. The separate sections may be pre-assembled or they may be assembled seriatim at a work site as soil penetration occurs. Typically, they are pre-assembled.

FIG. 31 illustrates a combination of features for use with a hollow tube 540 and bulbous bottom head element 542 that facilitate alignment of the hollow tube 540 for soil penetration. Thus, a special alignment guide device 544 in the form of an annular support ring fits around the hollow tube 540 and is fastened to the drive mechanism. The alignment guide device 544 serves to guide the combination hollow tube 540 and bottom head element 542 in the desired direction and location into a soil matrix. The alignment guide or element 544 also prevents "kick out" of the hollow tube 540, especially when the matrix soil is hard or dense. One or more such alignment guide devices 544 may be utilized. The hollow tube 540 is generally slidably or moveably mounted within the guide 544.

FIG. 32 illustrates a feature that may be incorporated into the bulbous bottom head element 542, namely the placement of a sensor device 546 within the bulbous bottom head element 542 for sensing the forces imparted by the bulbous head or bottom head element 542 on the material being discharged therefrom, as well as on the soil matrix. The force applied may be charted over time to provide a pattern of the effect of the bottom head element 542 upon compaction of the aggregate and upon penetration of the soil matrix.

FIG. 33 illustrates a mechanism utilized to force the hollow tube 550 and attached head element (not shown in FIG. 33) downwardly into a soil matrix (not shown in FIG. 33). More specifically, the upper end 554 of the hollow tube 550 is fitted into a short cylindrical section 553 of a guide tube 555 welded to a connection tube 557, in turn, welded to a solid metal fitting 559 with a plate 552. The plate 552 is a horizontal plate and thus forces directed axially against that plate 252 will impinge the plate 552 against the top end 554 of the hollow tube 550. A vibratory hammer 556 includes a mating plate 558 which may be fitted against the plate 552 and which is coupled thereto by means of rods or fasteners 561 projecting through the openings, such as opening 560, and latches 562 to retain the plates 552 and 558 joined together. The vibratory hammer 556 may then be operated to vibrate and drive the hollow tube 550 and head element (not shown) downwardly into the soil matrix onto compact discharged aggregate, etc.

FIG. 34 illustrates a form or shape of a pre-penetration device which may be used in combination with a hollow tube apparatus and head element as previously described. More particularly, a pre-penetration device may be utilized to form a preliminary opening or passage within a soil matrix, in particular, a stiff or medium dense soil. The device may comprise a vertical rod 570 with a leading end 572 which is shaped or configured to facilitate soil penetration, such as having the shape of a cone, for example. Generally, the large diameter end of the cone 572 is less than the maximum traverse dimension of a bulbous bottom head element associated with a subsequent step in the process, namely the step of using a bulbous bottom head element and hollow tube to penetrate into the soil matrix. The shape and configuration of the penetrating end 572, however, may be varied to accomplish the goal of providing a means to facilitate the creation of an initial passage in the soil matrix into which a hollow tube and associated bulbous bottom head element will subsequently be driven or inserted.

FIG. 35 illustrates another aspect of the method of the invention. That is, the method generally comprises use of a bulbous bottom head element, as described, and a hollow tube associated therewith to build a section or portion of an aggregate pier, such as a lower section 584, within a soil matrix 586. The region above the lower section 584 may subsequently be comprised of a pier construction, namely a pier construction 588, built in accord with some other teaching, for example the teaching as set forth in U.S. Pat. No. 5,249,892. The combination of pier sections of the type associated with the method of the present invention in combination with other pier forming methods is especially desirable or useful, inasmuch as the technologies are compatible and will enable the construction of deeper piers in a highly efficient and extremely fast manner inasmuch as the features associated with the respective sections compliment one another. For example, the upper pier portion formed by one teaching or method and apparatus may be of higher capacity than the lower pier portion associated with the method of the present invention. Stresses from loads are greater in the upper portion of a combined pier system. Two, or more than two, types of pier constructions in vertical alignment are considered to be within the scope of the invention.

FIG. 36 is a diagrammatic view illustrating a typical bottom plan view of a bulbous bottom head element made in accord with the invention. As previously described, the bulbous bottom head element 600 is a bulbous element and has a cross sectional dimension greater than that of the hollow tube element 602 attached adjacent thereto. The far distal end 590 of the bulbous bottom head element typically includes an opening 592 through which material such as aggregate or crushed stone, smooth stone, crushed concrete, grout, cementatious materials or the like, will flow during the practice of the method. The bottom opening 592 is typically, as depicted in various figures, of a lesser dimension than the horizontal face 590 at the extreme distal end 590 of the bulbous bottom head element 600. The opening 592 thus, is typically less than one half of the surface area of the traverse cross sectional area of the bottom head element 600. Surface 590 with the opening 592, connects with a shaped surface 594 which generally is a conical shape. As previously described, however, other shapes may be used to provide a transition from the outer surface 596 of the bulbous head element 600 to the extreme bottom surface 590 of the bulbous bottom head element 600. Moreover, the opening 592, as previously described, is initially covered by a plate or a sacrificial cap or a closable cover, for example, during initial soil matrix penetration.

Figure 38:
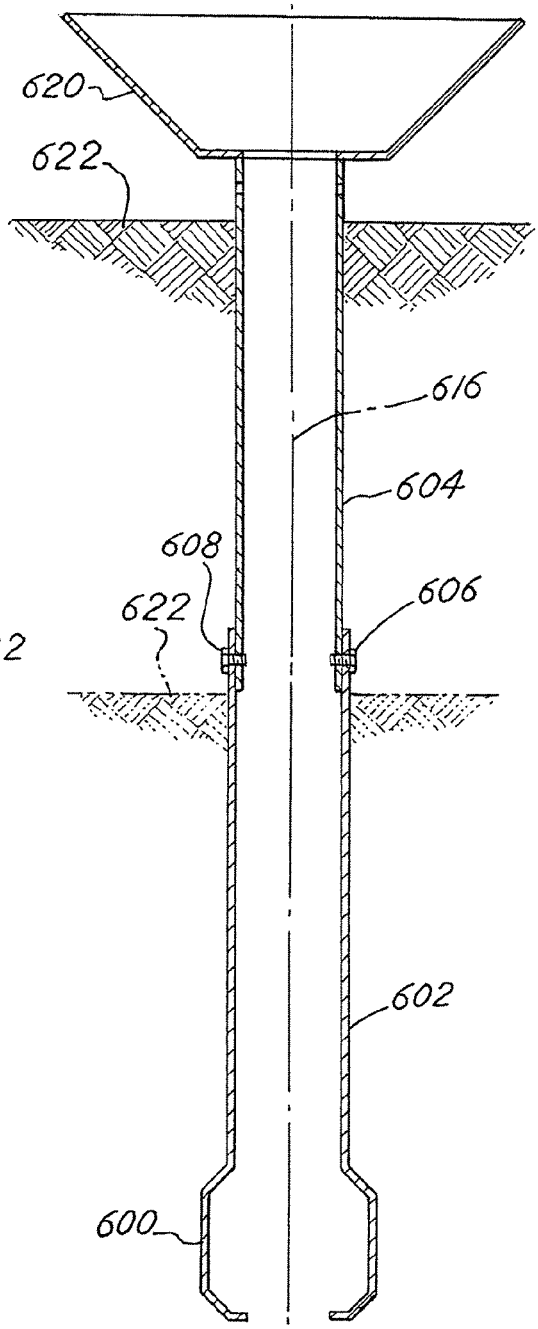
FIG. 38 is a further diagrammatic drawing of the embodiment of FIG. 37.
Figure 37:
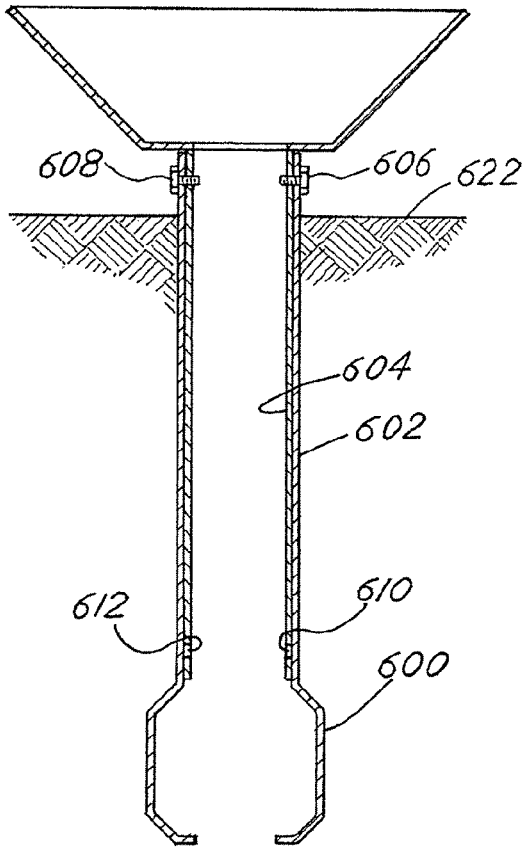
FIG. 37 is a diagrammatic drawing of an alternate construction comprising a telescoping hollow tube.

FIGS. 37 and 38 illustrate a further embodiment of the invention. Referring first to FIG. 37, there is disclosed a bulbous head element 600 which is attached to a hollow pipe or mandrel 602. The hollow pipe or mandrel 602 includes a generally equal length second mandrel or hollow pipe of lesser diameter; namely, pipe 604 slidably positioned therein. The hollow tubes or pipes 602 and 604 are joined together by bolts or pins 606 and 608 fitted through the upper end of the outer hollow tube 602 and the upper end of the interior hollow tube 604. The interior hollow tube 604 further includes at the lower end thereof passages or openings 610 and 612 discussed with respect to FIG. 38.

Referring to FIG. 38 the interior mandrel or tube 604 may telescope longitudinally in the direction of the longitudinal axis 616 upwardly relative to the lower mandrel or hollow tube 602 which is attached to the bulbous head element 600. The pins or bolts 606 and 608 are removed from connecting the outer tube 602 to the inner tube 604 as depicted in FIG. 37 and then reinserted through the openings and in particular the openings 610 and 612 to thereby elongate the effective operational limit or length of the hollow tube element which is comprised of the combination of lengths of the lower and larger diameter hollow tube 602 and the upper or lesser diameter hollow tube 604. A hopper or other mechanism may be provided for directing aggregate material into the interior of the hollow tubes 602 and 604.

The embodiment of FIGS. 37 and 38 is especially useful in that it enables the practice of the methodology associated with the invention at deeper depths within a soil matrix. That is, the soil matrix level is represented by the surface level 622 in FIG. 37. The combination of the bulbous head element 600 and the hollow tubes 602 and 604 may be placed in the soil matrix to the depth as illustrated in FIG. 37. Then, referring to FIG. 38, the tubes 602 and 604 may be telescoped and driven to a deeper depth. That is, the interior hollow tube 604 may be extended as shown in FIG. 38 and the entire assembly then pushed down or placed further into the soil. In this manner, the combination of the bulbous head element 600 and the hollow tubes 602 and 604 may be inserted to a much greater depth easily and quickly. The material fed through the hollow tube 602 and 604 may then be fed therein using the methodologies such as previously described. The telescoping tubes 602 and 604 enable a significant increase of the depth which the methodology of the invention may be practiced in a very quick, efficient and economical manner. Of course, all of the other features previously described may be used in combination with the telescoping mandrels or tubes described with respect to FIGS. 37 and 38. Also, additional telescoping tubes may be utilized, although there may be a practical limit to such usage. Typically, the larger diameter tube 602 is attached to head element 600 and positioned on the outside of the next telescoping tube 604 as illustrated in FIGS. 37 and 38, although the reverse may be adopted also with a larger diameter tube being on the outside of the smaller diameter tube and the larger diameter tube being the tube which is raised or extended upwardly or telescoped away from the bulbous head element 600.

Various modifications and alterations may thus be made to the methodology as well as the apparatus to be within the scope of the invention. Thus, it is possible to vary the construction and method of operation of the invention without departing from the spirit and scope thereof. Alternative hollow tube configurations, sizes, cross sectional profiles and lengths of tube may be utilized. The bulbous bottom head element 32 may be varied in its configuration and use. The bottom valve 54 may be varied in its configuration and use, or may be eliminated by adoption of a sacrificial cap. The leading end of the bulbous bottom head element 32 may have any suitable shape. For example, it may be pointed, cone shaped, blunt, angled, screw shaped, or any shape that will facilitate penetration of a matrix soil and compaction of discharged aggregate material. The enlarged or bulbous bottom head element 32 may be utilized in combination with one or more differing external diameter sections of the hollow tube 30 having various shapes or configurations. Therefore the invention is to be limited only by the following claims and equivalents thereof.

What is claimed is:

1. A method for forming an aggregate pier in a matrix soil comprising the steps of:

a) forming an elongate cavity having a bottom, sidewalls, and a longitudinal axis in a matrix soil by lowering a hollow tube with a bulbous bottom head element having an open end at the extreme end thereof including a closure mechanism for closing the extreme open end, the open end being in-line with the hollow tube, said bulbous bottom head element configured with a greater cross sectional area portion than the cross sectional area of the adjacent connected hollow tube and further comprising a leading edge tapered upwardly and outwardly from a bottom thereof, and a trailing edge tapered downwardly and outwardly at a top thereof at the connection between the bulbous bottom head element and the hollow tube, defining surfaces configured to provide axial and outwardly transaxial vector forces upon a matrix soil when being lowered into and raised out of the matrix soil, said bulbous bottom head element having a length between the leading edge and the trailing edge of at least one times the bulbous bottom head element diameter, and said closure mechanism closed during formation of the elongate cavity to prevent aggregate material discharge from the bulbous bottom head element during formation of the cavity and to prevent clogging of the bulbous bottom head element or hollow tube with matrix soil materials during penetration and formation of the elongate cavity;

b) raising the hollow tube a predetermined first incremental distance in the formed cavity;

c) opening the closure mechanism when the hollow tube is raised;

d) feeding pier forming aggregate material through the bulbous bottom head element extreme open end into the portion of the cavity revealed by raising the hollow tube said first incremental distance; and e) lowering the hollow tube and bulbous bottom head element in unison a predetermined second incremental distance to compact the discharged aggregate material in the cavity by axial and outwardly transaxial force impact from the bulbous bottom head element onto the discharged aggregate material surface while displacing a portion of the pier forming aggregate material transaxially outwardly against and into the sidewalls of the filled cavity.

2. The method of claim 1 wherein the hollow tube is initially forced a predetermined distance into the matrix soil to form an elongate cavity.

3. The method of claim 2 including the step of providing a static force on the hollow tube to effect driving of the hollow tube and to effect compacting of discharged aggregate.

4. The method of claim 2 including the step of providing a dynamic axial force and a static force on the hollow tube to effect driving of the hollow tube and to effect compacting of discharged aggregate.

5. The method of claim 1 wherein the elongate cavity or a portion of its diameter is initially formed by pre-drilling or pre-penetrating the matrix soil to form an elongate cavity with diameter approximately the same as that of the bottom head element or slightly less than that of the bottom head element and to subsequently lower or partially lower and partially force, the hollow tube with bulbous bottom head element into the pre-formed elongate cavity.

6. The method of claim 1 including the repetition of steps b) through e).

7. The method of claim 1 including the step of closing the closure mechanism before compacting.

8. The method of claim 1 including the additional step of separately feeding a material in combination with the aggregate material to facilitate aggregate flow and/or to increase the strength and/or stiffness of the formed aggregate pier.

9. The method of claim 1 wherein the step of compacting the discharged aggregate comprises reducing the axial dimension of the compacted lift to about ½ to ¼ of the uncompacted aggregate incremental distance to form a compacted aggregate lift having a vertical axial dimension of about ½ to ¼ of the incremental distance the apparatus was raised during step (b).

10. A method for forming an aggregate pier in a matrix soil comprising the steps of:

(a) forming an elongate cavity having a bottom, sidewalls, and a longitudinal axis in a matrix soil by positioning a hollow tube with a bulbous bottom head element into the matrix soil to a predetermined depth, said bulbous bottom head element having a bulbous shape with a maximum cross sectional area greater than the attached hollow tube adjacent thereto, said bulbous bottom head element further comprising a leading edge tapered upwardly and outwardly from a bottom thereof, and a trailing edge tapered downwardly and outwardly at a top thereof at the connection between the bulbous bottom head element the hollow tube, defining surfaces configured to impart axial and outwardly transaxial forces when being lowered into and raised out of the matrix soil and on discharged materials and having an extreme bottom end discharge opening with a cover plate, the discharge opening being in-line with the hollow tube, and said bulbous bottom head element having a length between the leading edge and the trailing edge of at least one times the bulbous bottom head element diameter;

(b) raising the hollow tube an incremental distance from the bottom of the cavity;

(c) opening the bottom discharge opening and feeding pier forming material through the hollow tube into the cavity upon raising of the hollow tube; and (d) vertically compacting the pier forming material with the bulbous bottom head element by driving the hollow tube and bulbous bottom head element downwardly in unison toward the bottom of the cavity while displacing a portion of the pier forming material transaxially into the sidewalls of the cavity.

11. The method of claim 1 further including the step of forming a second pier or pile segment of a type not formed by method of claim 1 upon an aggregate pier formed by the method of claim 1.

12. The method of claim 1 including the additional step of preloading the formed aggregate pier to increase its capacity and strength.

13. The method of claim 1 including the step of placing one or more generally aligned rods with the hollow tube, said rod or rods extending upwardly from a plate.

14. The method of claim 1 wherein the first incremental distance is varied for at least one of the repetitions.

15. The method of claim 1 wherein the first incremental distance is substantially equal to the height of the pier to be formed.

16. Apparatus for construction of a soil reinforcement aggregate pier in a soil matrix comprising, in combination:

(a) an elongate hollow tube having a longitudinal axis with a material entrance opening and a bulbous bottom head element having an open bottom discharge end, the external cross section and diameter of the bulbous bottom head element being greater than the external cross section and diameter of the hollow tube adjacent thereto to thereby form a bulbous bottom head element section of the hollow tube having an external cross sectional shape and size greater than the external cross sectional shape and size of the hollow tube adjacent the bulbous end;

(b) said bulbous bottom head element further comprising a leading edge tapered upwardly and outwardly from a bottom thereof, and a trailing edge tapered downwardly and outwardly at a top thereof at the connection between the bulbous bottom head element the hollow tube, defining surfaces configured to impart axial and outwardly transaxial forces upon downward and upward movement on a soil matrix and aggregate material; and said bulbous bottom head element having a length between the leading edge and the trailing edge of at least one times the bulbous bottom head element diameter; and (c) said bulbous bottom head element including a material discharge opening at the extreme end thereof in-line with the hollow tube and further comprising a removable cover plate or a valve that is able to open and close.

17. The apparatus of claim 16 wherein the hollow tube is further comprised of multiple sections each having a distinct cross sectional area.

18. The apparatus of claim 16 further including at least two rods mounted externally of the hollow tube and head element, said rods attached to a plate external the hollow tube and head element.

19. The apparatus of claim 18 wherein the rods comprise uplift anchor rods as part of an uplift anchor system.

20. The apparatus of claim 18 wherein the rods comprise tell-tale members.

21. The apparatus of claim 16 further including an alignment mechanism for stabilizing the hollow tube and preventing it from laterally translating.

22. The apparatus of claim 16 further including a pressure detection sensor device mounted within the bulbous bottom head element to sense pressure.

23. The apparatus of claim 16 in combination with a separate soil matrix pre-penetration device to form a cavity prior to inserting the elongate hollow tube with bulbous bottom head element into the ground.

24. The apparatus of claim 16 further including a first plate mounted to the hollow tube and a second plate attached to a vibratory hammer, said first and second plates capable of being connected together by connecting rods and a lock mechanism.

25. The apparatus of claim 16 wherein said hollow tube is comprised of at least two telescoping longitudinal sections and one of said sections is attached to said bottom head element.

26. The apparatus of claim 25 including a releasable fastening mechanism for attaching the sections together in a non-telescoping configuration.

27. The apparatus of claim 25 wherein said sections are concentric.

28. The apparatus of claim 25 wherein the sections comprised a first larger diameter section attached to the head element and a second section slidably positioned within the first section.

29. The apparatus of claim 25 including a radial pin removably connecting the sections.

* * * * *